US010501241B2

(12) United States Patent
Berge

(10) Patent No.: US 10,501,241 B2
(45) Date of Patent: Dec. 10, 2019

(54) MOUNTING PORTION FOR A SPOUT

(71) Applicant: Silgan White Cap LLC, Downers Grove, IL (US)

(72) Inventor: Gary Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 15/866,408

(22) Filed: Jan. 9, 2018

(65) Prior Publication Data

US 2018/0201415 A1 Jul. 19, 2018

Related U.S. Application Data

(63) Continuation of application No. PCT/US2017/014123, filed on Jan. 19, 2017.

(51) Int. Cl.
*B65D 47/12* (2006.01)
*B65D 75/58* (2006.01)
(Continued)

(52) U.S. Cl.
CPC ..... *B65D 47/122* (2013.01); *B65D 41/3428* (2013.01); *B65D 75/008* (2013.01);
(Continued)

(58) Field of Classification Search
CPC ..... B65D 47/122; B65D 41/3428; B65D 75/008; B65D 75/5883; B65D 2575/583; B65D 2575/586; B65D 33/01; A61L 2/00
(Continued)

(56) References Cited

U.S. PATENT DOCUMENTS 5,823,383 A * 10/1998 Hins ..... B29C 65/02 220/601
6,241,122 B1 * 6/2001 Araki ..... B65D 47/06 222/107

(Continued)

FOREIGN PATENT DOCUMENTS

WO WO 03-004361 1/2003
WO WO 2016-149259 9/2016

OTHER PUBLICATIONS

International Search Report and Written Opinion regarding PCT/US17/14123, dated Sep. 15, 2017, 16 pages.

*Primary Examiner* — Lien M Ngo
(74) *Attorney, Agent, or Firm* — Reinhart Boerner Van Deuren s.c.

(57) ABSTRACT

A spout includes a mounting portion to which a pouch of a container assembly is sealed. The exterior of the mounting portion is defined by a smooth, non-angled surface free of edges or sharp transition portions, and is defined along its height by a generally sinusoidal, wave-like pattern formed by alternating peaks and troughs. The exterior of the mounting portion is structured such that the ratio of the length of the portion of the mounting portion exterior surface extending between adjacent peaks to the height between adjacent peaks is minimized to no more than 10%, and more preferably no more than 5%. By minimizing this ratio, the amount that a pouch will stretch if it is pushed into the cavities formed between adjacent peaks of the mounting portion (e.g. during an HPP process) is minimized, thereby preventing damage to the pouch and/or attachment between the pouch and spout.

12 Claims, 30 Drawing Sheets

(51) Int. Cl.
*B65D 41/34* (2006.01)
*B65D 75/00* (2006.01)

(52) U.S. Cl.
CPC .... *B65D 75/5883* (2013.01); *B65D 2575/583* (2013.01); *B65D 2575/586* (2013.01)

(58) Field of Classification Search
USPC ..... 222/92, 107; 383/80, 100–103, 904–907
See application file for complete search history.

(56) References Cited

U.S. PATENT DOCUMENTS

| | | | | |
|---|---|---|---|---|
| 6,991,140 | B2 * | 1/2006 | Bourque | B65D 47/148 215/48 |
| 7,762,430 | B2 * | 7/2010 | Wild | B65D 75/008 222/107 |
| 8,292,121 | B2 * | 10/2012 | Davideit | B65D 83/425 222/105 |
| 10,005,602 | B2 * | 6/2018 | Van Der Molen | B65D 75/5883 |
| 2009/0008416 | A1 | 1/2009 | Kurosawa et al. | |
| 2010/0213213 | A1 * | 8/2010 | Albers | B65D 41/3409 222/153.05 |
| 2014/0110433 | A1 | 4/2014 | Schick | |
| 2015/0129533 | A1 * | 5/2015 | Taber | B65D 75/5883 215/252 |
| 2015/0360830 | A1 * | 12/2015 | Niggemyer | B65D 75/5883 222/105 |
| 2016/0272380 | A1 | 9/2016 | Mazurkiewicz et al. | |
| 2017/0107024 | A1 * | 4/2017 | Tamarindo | B65D 75/5883 |
| 2017/0225852 | A1 * | 8/2017 | Ohkubo | B65D 47/36 |
| 2017/0319001 | A1 * | 11/2017 | Butscher | A47J 31/407 |

* cited by examiner

MOUNTING PORTION FOR A SPOUT

CROSS-REFERENCE TO RELATED PATENT APPLICATION

This application is a continuation of International Application No. PCT/US17/14123, filed Jan. 19, 2017, which is incorporated herein by reference in its entirety.

BACKGROUND

The present invention relates to a container assembly having a spout with a modified mounting portion. The modified mounting portion is configured to minimize or prevent any damage to the pouch and/or the connection between the spout and pouch when changes in temperature and/or pressure occur, or when external forces are imparted onto the container assembly.

SUMMARY OF THE INVENTION

In one embodiment, a spout for use with a flexible container includes a flow channel configured to fluidly connect an interior of the container with a location outside the container. A mounting portion is formed about the flow channel.

The mounting portion comprises a generally vertically extending wall having an inner surface and an exterior surface. The inner surface of the wall defines an opening that is in fluid communication with the flow channel and the interior of the container.

One or more horizontally extending raised elements extend radially outwards from the exterior surface of the wall. Each of the raised elements have a mounting surface configured for sealing to an inner surface of the container.

A distance as measured along a height of the mounting portion between a first mounting surface of a first element and a second mounting surface of an adjacent second element is defined by a length H. A distance as measured along the periphery of a portion of the exterior surface extending between the first mounting surface and the second mounting surface is defined by a length P. The length P is no more than 10% greater than the length H.

In one embodiment, a spout for attachment to a flexible pouch includes a cylindrical tube surrounding a central channel. The tube has an inlet end and an outlet end. A mounting portion is located along a lower portion of the tube.

The mounting portion includes first and second walls. Each of the first and second walls have an interior surface, an exterior surface, a first vertical edge and a second vertical edge. The first and second walls are attached to one another along their first and second vertical edges. An opening is defined between the interior surfaces of the first and second wall. The opening is in fluid communication with the inlet end of the tube so that contents of a pouch may be accessed from outside of the pouch through the central channel and the opening.

The exterior surfaces of each of the first and second walls define a curvilinear wave-like pattern formed of alternating peaks and troughs. The pattern of each of the first and second exterior surfaces extend along a height of the mounting portion from bottom ends of the first and second walls to top ends of the first and second walls.

In one embodiment, a pouch and spout assembly includes a pouch defining an interior in which contents may be stored and a spout. The spout includes a flow channel that fluidly connects the interior of the pouch with a location outside the pouch. A mounting portion is formed about the flow channel.

The mounting portion includes a generally vertically extending wall having an inner surface and an exterior surface. The inner surface of the wall defines an opening that is in fluid communication with the flow channel and the interior of the pouch.

One or more mounting structures extend radially outwards from and spaced along a height of the exterior surface of the wall. An inner surface of the pouch is sealed to the spout along the mounting structures to form a fluid-tight interface.

One or more cavities are formed between adjacent mounting structures. Each cavity is bounded in its entirety by the inner surface of the portion of the pouch extending between the adjacent mounting structures and the portion of the exterior surface wall extending between the adjacent mounting structures.

The arrangement of the mounting structures along the exterior surface of the wall prevents the portion of the pouch extending between adjacent mounting structures to stretch any more than 10% relative to the original length of the portion of the pouch when the pouch is forced radially inwards from an initial location towards the exterior surface of the wall.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a container assembly including a pouch, closure and related spout are described. In particular embodiments, the spout includes a mounting portion that is configured to minimize or prevent damage to the pouch and/or the connection between the spout and pouch. In some embodiments, the spout and/or pouch may additionally include one or more vents that provide for fluid communication between the ambient environment and internal spaces formed between the pouch and the spout to allow for pressure within the internal spaces to equalize with respect to the ambient environment. In some embodiments, the closure comprises a tamper band that includes one or more hinges configured to increase the resistance required to break the tamper band so as to prevent the tamper band from inadvertently distorting and/or breaking prior to twist-off of the closure from the spout during opening of the container.

The closure and the tamper band discussed herein may be particularly suitable for containers, for example food or drink containers, intended for use by children. For example, because the tamper band remains attached to the closure after the container is opened, the likelihood that the tamper band is accidentally swallowed by a user may be reduced. Specifically, because the tamper band is removed along with the removal of the closure, it does not remain near the opening of the container where a user may place their mouth. Furthermore, because in some embodiments the wall sections of the tamper band are attached at both ends to the upper portion of the closure by hinges located at each end of the wall section, the radially outward movement of the wall sections after the tamper band has been broken is relatively constrained. As such, in the event the closure is swallowed by a user, the broken, free ends of the tamper band are less likely to damage or pierce the airway of the user.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
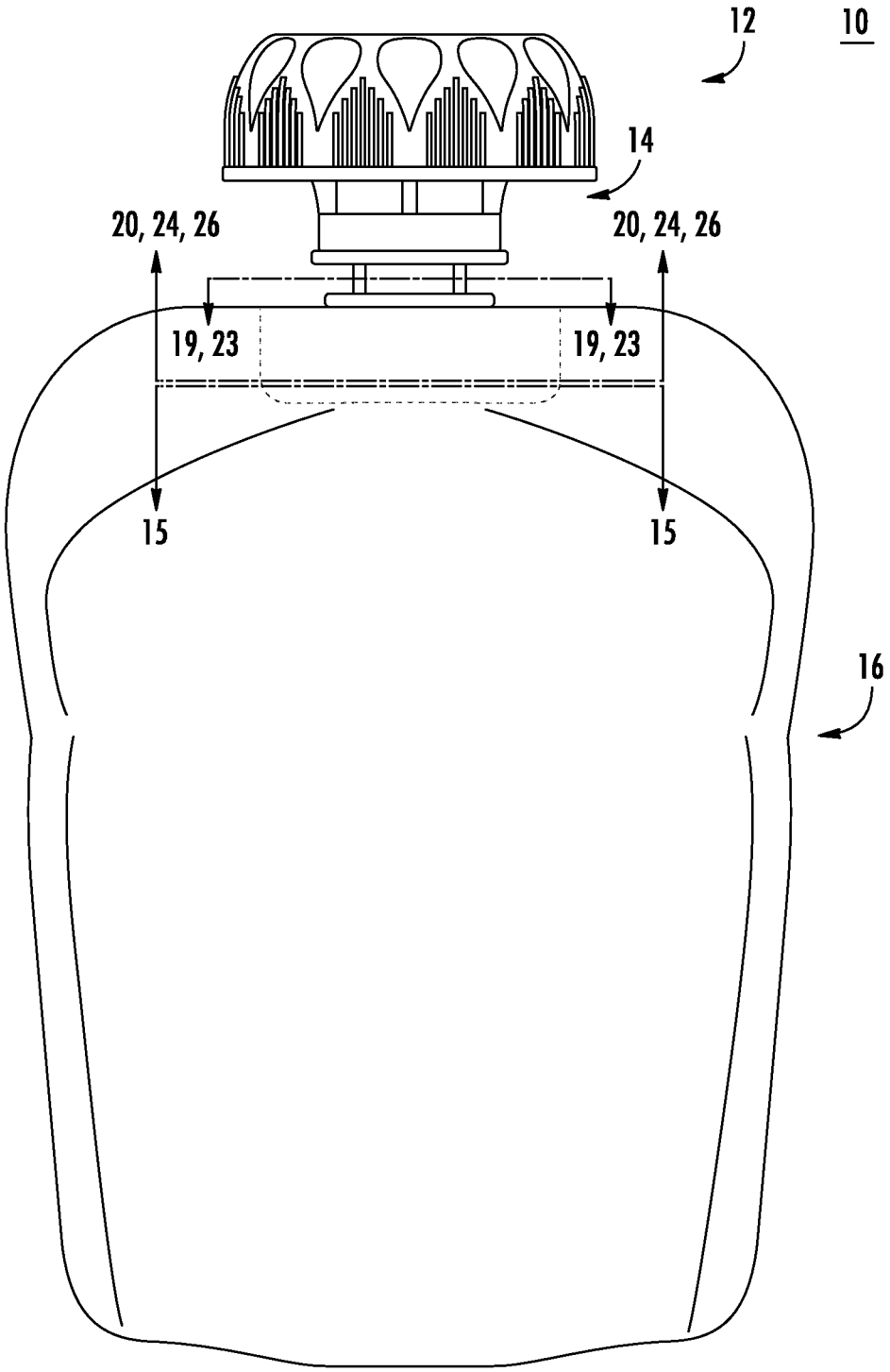
FIG. 1 shows a container assembly including a closure and spout assembly attached to a pouch-type container according to an exemplary embodiment.

FIG. 1 shows a container assembly 10 according to one embodiment. Container assembly 10 includes a container, shown as pouch 16 and a closure assembly, including a closure 12 and a spout 14. In general, pouch 16 includes container contents, such as liquid, semi-liquid, or powdered food or beverage, within pouch 16, and spout 14 provides a channel through which the contents of pouch 16 can be accessed. In the embodiment shown, pouch 16 is a flexible, squeezable type of container which may be formed from a flexible material. In various embodiments, the flexible material may be a material such as a thermoplastic sheet or a foil pouch. In other embodiments, closure 12 and spout 14 may be used in conjunction with other types of containers, such as plastic bottles or composite (paper, cardboard, etc.) boxes, or pouches fabricated from suitable laminated materials. In specific embodiments, the contents of pouch 16 may be food or beverage intended for consumption by a child, such as baby food, yogurt, apple sauce, etc.

As will be generally understood, the lower end of pouch 16 may provide an end wall or rim providing a stable base for pouch 16 to sit in the upright position shown in FIG. 1. The spout 14 may be assembled with the closure 12 before attachment of the spout 14 to a pouch 16 that has been prefilled with contents. Alternatively, the spout 14 may be inserted into an empty pouch 16 that is then filled with contents through the spout 14, after which the closure 12 is added to the spout 14.

In various embodiments, the closure 12 and/or spout 14 may be formed from a molded plastic material. In various embodiments, closure 12 and/or spout 14 may be polyethylene, polypropylene, polyethylene terephthalate, or any other suitable plastic material. In various embodiments, the closure 12 and/or spout 14 may be formed through any suitable molding method including injection molding, compression molding, etc.

Figure 2:
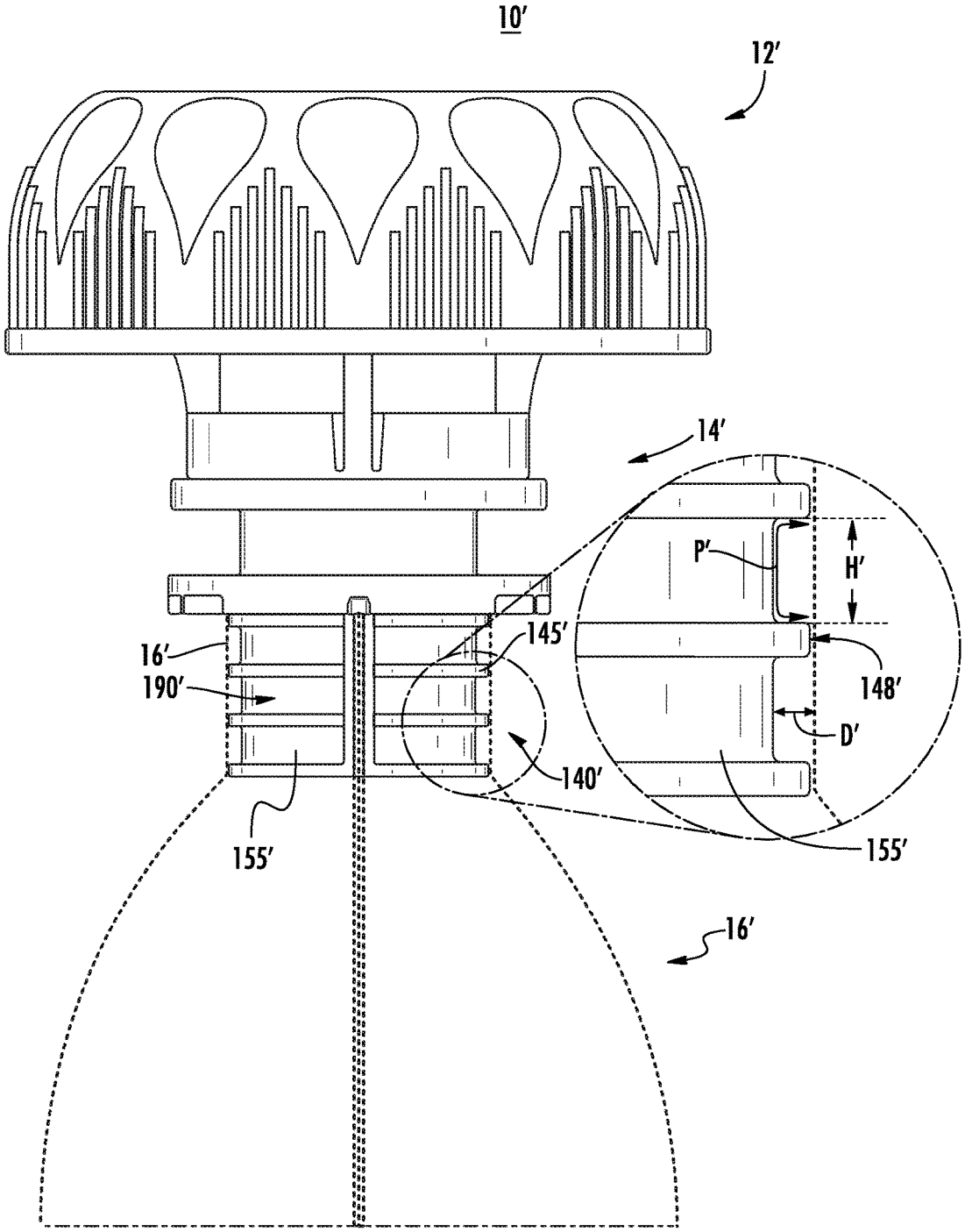
FIG. 2 is a side view of a container assembly having a spout with a conventional mounting portion prior to undergoing high pressure processing.

Shown in FIG. 2 is one embodiment of a container assembly 10' comprising a spout 14' having a conventional mounting portion 140'. As illustrated in FIG. 2, conventional mounting portion 140' includes a central structure 155' surrounding a central channel 152' that fluidly connects the contents of the interior of the pouch 16' with the exterior environment when the pouch 16' and spout 14' are attached.

Extending radially outwards from the central structure 155' is a bottom sealing wall 143'. Also extending radially outwards from the central structure 155' and located above bottom sealing wall 143' are a plurality of horizontally spaced ribs 145'. As shown in FIG. 2, the outermost peripheries of bottom sealing wall 143' and ribs 145' are defined by generally identical geometries and dimensions. Defining the outermost peripheries of ribs 145' and bottom sealing wall 143' are outer surfaces 148' that extend in between and generally perpendicular to the upper and lower surfaces of bottom sealing wall 143' and each of the ribs 145'.

The inner surfaces of pouch 16' are attached to the mounting portion 140' of spout 14' along the outer surfaces 148' of bottom sealing wall 143' and ribs 145' to form container assembly 10'. Once the pouch 16' has been attached to the mounting portion 140', the only fluid communication between the interior of the pouch 16' and the exterior environment is through the central channel 152'.

Referring to FIG. 2, when the pouch 16' is attached to the mounting portion 140' along the outer surfaces 148' of bottom sealing wall 143' and ribs 145', empty spaces or cavities 190' are defined between adjacent ribs 145' and between the bottommost rib 145' and bottom sealing wall 143'.

As shown in FIG. 2, the volume of cavities 190' is defined by the upper and lower surfaces of adjacent ribs 145'; the exterior surface of the central structure 155' extending between the upper and lower surfaces of adjacent ribs 145'; and the interior surface of the portion of the pouch 16' extending between the upper and lower surfaces of adjacent ribs 145'.

Referring to the enlarged portion of FIG. 2, the portion of the outer surface of the mounting portion 140' extending between the outer surfaces 148' of adjacent ribs 145' defines an outer periphery P'. Periphery P' extends along the lower surface of a first rib 145', the outer surface of central structure 155' and the upper surface of a second adjacent rib 145' located below the first 145'. A height H' is defined by the distance between adjacent ribs 145', and also corresponds to the length of the portion of pouch 16' extending between the outer surfaces 148' of adjacent ribs 145'.

Owing to the large spacing D' between the outer surfaces 148' of ribs 145' and the outer surface of the exterior of the central structure 155', as well as the angular, perpendicular arrangement of ribs 145' along central structure 155', the length of the perimeter P' is significantly (i.e. more than 10%) greater than the length H' between adjacent outer surfaces 148'.

When a spout 14' having a conventional mounting portion 140' such as shown in FIG. 2 is sealed, bonded, or otherwise attached to pouch 16', air may become trapped between spaces 190'. As the ambient temperature and/or pressure in which the assembled pouch 16' and spout 14' assembly are stored changes or fluctuates, the pressure within spaces 190' and/or the volume of the air trapped in spaces 190' may also change. These changes in ambient pressure and/or temperature may occur unintentionally, for example during storage or transport. In other embodiments, the changes in ambient pressure and/or temperature may be imparted intentionally, e.g. during preservation of sterilization procedures such as high pressure processing ("HPP") or pascalization.

Figure 3:
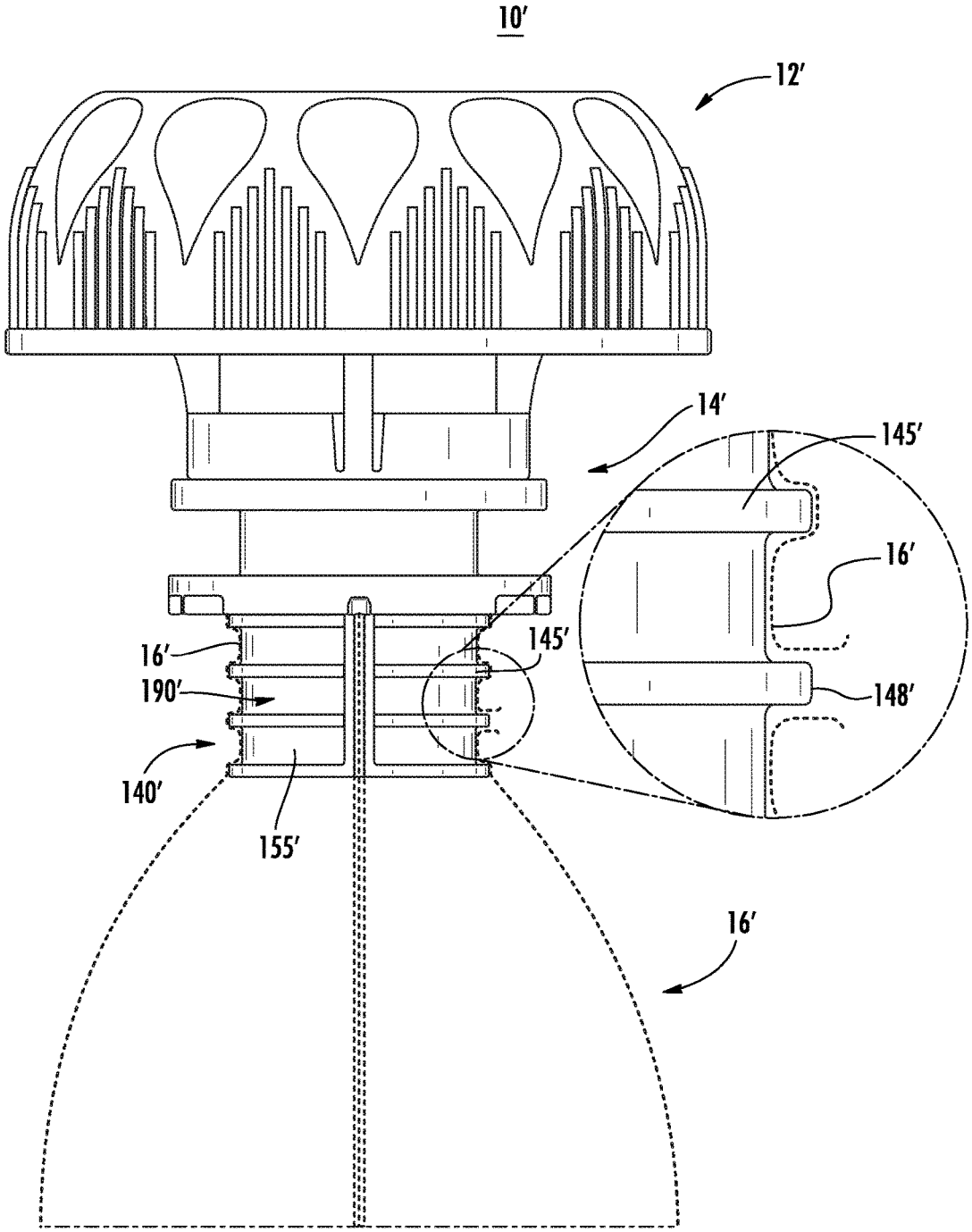
FIG. 3 is a side view of the container assembly of FIG. 2 undergoing high pressure processing, as well as an enlarged view thereof.

Referring to FIG. 3, the container assembly 10' of FIG. 2 is shown undergoing HPP. During the HPP process, such as provided by Avure Technologies, filled containers are placed under pressures of over 80,000 psi using a fluid, such as water. By processing foods at extremely high water pressure (up to 6,000 bar/87,000 psi—more than the deepest ocean), Avure represents that its HPP machines neutralize *listeria, salmonella, E. coli* and other deadly bacteria that may be present in the contents of the containers prior to the HPP process. Unlike thermal, chemical and other high-heat treatments, HPP runs at cold temperatures to reduce altering food taste, texture or quality, or the requirement of adding of chemicals to maintain freshness or to exceed shelf-life.

During the HPP process, the ambient pressure surrounding the container assembly 10' is increased. As the ambient pressure surrounding the container 10' increases, increasing forces are exerted on the outer surfaces of the sidewalls of pouch 16'. However, despite the changing external pressure, because cavities 190' are sealed from the ambient environment (i.e. there is no fluid communication between the cavities 190' and the ambient environment) the pressure within cavities 190' remains unchanged. Because the pressure within cavities 190' remains unchanged, the forces exerted on the inner surfaces of the sidewalls of pouch 16' remain unchanged during HPP.

As the ambient pressure continues to increase during HPP, the forces exerted on the outer surfaces of the sidewalls pouch 16' also increase, thereby causing an imbalance between the forces applied to the exterior surfaces of the pouch 16' and the forces applied to the interior surfaces of the pouch 16', with the forces acting on the exterior surfaces of the pouch 16' being greater than the forces acting on the inner surfaces of the pouch 16'. As the difference in the pressure outside of the container assembly 10' and pressure within cavities 190' continues to increase, the greater forces acting on the exterior surfaces of the pouch 16' begin to push the pouch 16' into cavities 190'.

Given the structure of the conventional mounting portion 140', the imbalance between the forces acting on the exterior surfaces of the pouch 16' and those acting on the interior surfaces of the pouch 16' may result in damage to the attachment/bond between the pouch 16' and spout 14' and/or damage to the material forming the pouch 16'. Specifically, the large ratio (i.e. greater than 10% difference) between the length of the perimeter P' of the portion of the outer surface of the mounting portion 140' extending between the outer surfaces 148' of adjacent ribs 145' and the height H' of the portion of the pouch 16' extending between adjacent ribs 145' as well as the corresponding large volume defined by cavities 190', provide a large surface area and volume along which/into which the pouch 16' may increasingly be pushed into.

Because the configuration and structure of the conventional mounting portion 140' defines a large area and space, as increasing forces push the pouch 16' inwards, the large surface area P' and the large volume of spaces allow the pouch 16' to be collapsed/forced further and further into cavities 190'. As the pouch 16' continues to be forced farther inwards, the material forming the pouch 16' is stretched and may begin to deform, resulting in permanent deflection of the material of the pouch 16'. In some circumstances, such as illustrated in the enlarged section of FIG. 3, this stretching of the pouch may eventually cause the pouch 16' to tear, rupture or otherwise fail.

Additionally, as pouch 16' is pushed further into spaces 190', increasing amounts of stress and strain are imparted onto the interface/attachment/bond between the pouch 16' and the conventional mounting portion 140'. These imparted forces may act to adversely affect, deteriorate, detach, or otherwise impair the initial fluid-tight sealing engagement formed between the pouch 16' and the conventional mounting portion 140' of spout 14'.

Moreover, the sharp, angled edges of ribs 145' may further damage the pouch as the pouch 16' is forced inwards. As pouch 16' is pushed into spaces 190', the material of the pouch 16' is increasingly deflected as it is stretched over the sharp, angled edges of ribs 145'. In some circumstances, such as e.g. shown in the enlarged portion of FIG. 3, this deflection or stretching of the pouch 16' over the edges of ribs 145' may result in a large enough concentration of stress on the material of the pouch 16' to contribute to and eventually lead to the material failure of the pouch 16', e.g. resulting intearing or rupturing of the pouch 16'.

As illustrated by FIGS. 2 and 3, one of challenges of using container assemblies 10 in situations where the container assembly 10 may be subject to changes in pressure and/or temperature and/or other external forces (such as, e.g. during HPP), is the development of pouches 16, spouts 14, and/or pouch 16/spout 14 interfaces that can withstand such changes without negatively affecting the container assembly 10. Shown is FIGS. 4-35 are various embodiments of spout 14 and/or pouch 16 features that may be incorporated into a container assembly 10 and which are configured to prevent or limit the tearing, detachment, rupturing, degradation, deformation and/or other damage of the pouch 16 and/or the attachment between the spout 14 and pouch 16 that container assembles 10' having conventional mounting portions 140' are normally susceptible to.

As illustrated in and described with references to FIGS. 4-12, in various embodiments spout 14 comprises a mounting portion 40 configured to minimize the spaces 190 formed between the inner surfaces of pouch 16 and the exterior surfaces of mounting portion 40 when pouch 16 and spout 14 are attached. In various embodiments, the mounting portion 40 may also be configured to be defined by generally smoothly transitioning external surfaces having large radii of curvature and formed free of, or with minimal amounts of angled portions so as to avoid stress concentrations. The incorporation of such features in the mounting portion 40 minimizes or prevent the material of the pouch 16 from permanently deflecting, tearing, rupturing or otherwise failing in the event the pouch 16 is stretched across the exterior surfaces of the mounting portion 40, such as may occur, for example during HPP In other embodiments, such as e.g. illustrated in and described with reference to FIGS. 13-33, one or more vent features may be incorporated into the spout 14 and/or pouch 16 of container assembly 10. The vents may be configured to allow for fluid communication between the spaces 190 defined by mounting portion 140 and the ambient environment. By providing a path for air to pass between the ambient environment and cavities 190, pressure within spaces 190 is allowed to equalize with that of the ambient pressure such that the pouch 16 is not collapsed into spaces 190 when the ambient pressure changes.

In yet other embodiments, such as illustrated in the exemplary embodiment of FIGS. 34 and 35, the container assembly 10 may include both a spout 14 having a modified mounting portion 40 such as described with reference to FIGS. 4-12 as well as one or more vent structures formed in the pouch 16 and/or spout 14, such as described with reference to FIGS. 13-33.

Figure 4:
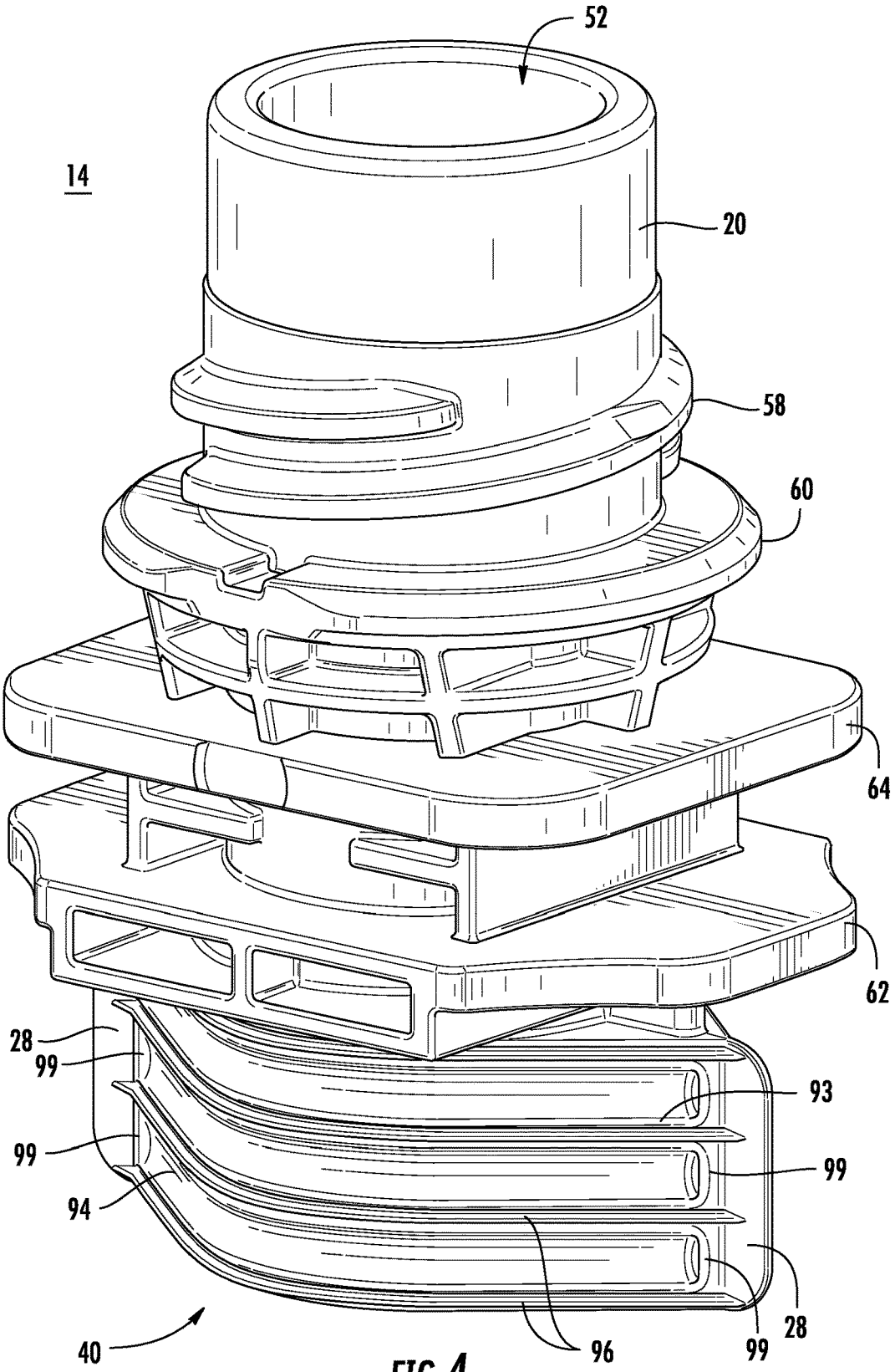
FIG. 4 is a top perspective view of a spout having a mounting portion according to an exemplary embodiment.
Figure 5:
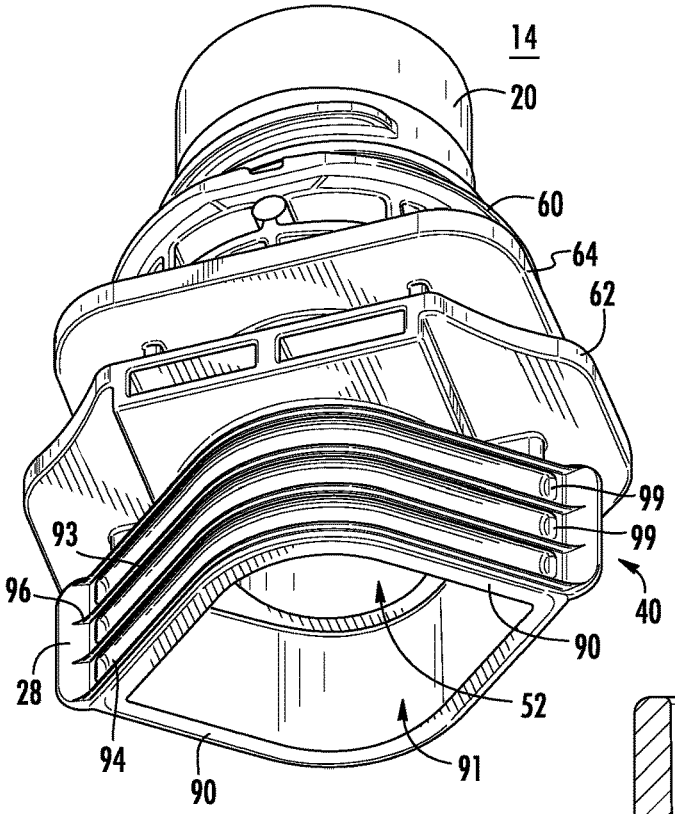
FIG. 5 is a bottom perspective view of the spout of FIG. 4.
Figure 6:
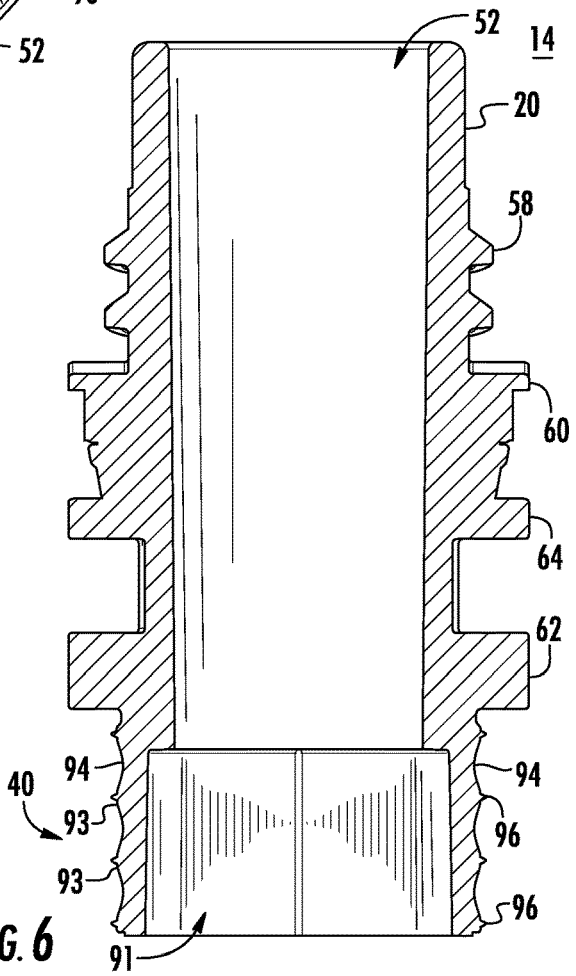
FIG. 6 is a cross-sectional view of the spout of FIG. 4.

Referring to FIGS. 4-6, a spout 14 having a mounting portion 40 according to one embodiment is illustrated. As shown in FIG. 4, spout 14 includes a tube 20 extending about the longitudinal axis of the spout 14 and defining a central channel 52 that extends through spout 14 from an input or inlet opening to an output or outlet opening. In general, central channel 52 provides a pathway from the interior of a container (such as pouch 16) to the exterior of the container through which container contents can be accessed and removed. Located on the upper portion of spout 14 is a closure engagement structure, shown as threads 58 that engage cooperating threads 59 of closure 12.

Below threads 58, the spout 14 may include one or more annular flanges that extend radially out from the exterior surface of the tube 20. As shown in FIG. 4, in one embodiment spout 14 includes an upper flange 60, a central flange 64, and a lower flange 62.

Located below lower flange 62 is a mounting portion 40. As shown in FIGS. 4 and 5, in some embodiments mounting portion 40 may have a generally trapezoidal shape, e.g. a rhomboid shape, with rounded vertices, such as the canoe-shape defined by first and second walls 90. As shown in FIGS. 4 and 5, the side edges of the first and second walls 90 may be joined, with the interior surfaces of the first and second walls 90 defining an opening 91 which is in fluid communication with the central channel 52. In other embodiments, the bottom of mounting portion 40 may be sealed by an end wall extending between first and second walls 90, with an opening being provided in the end wall that provides fluid communication between the interior of the pouch 16 and the central channel 52.

In some embodiments, such as illustrated by the embodiment of FIGS. 4-6, the ends of the first and second walls 90 may be joined along outwardly extending wings 28 located at each of the first and second ends of the walls 90. As shown in FIG. 4, wings 28 are formed of generally flat, smooth planar structures that extend from the bottom to the top ends of walls 90. When the spout 14 is attached to the pouch 16, the wings 28 extend within the pouch 16 and are attached to the inner surfaces of the sidewalls of the pouch 16, such that spout 14 is supported from the pouch 16 as shown in FIG. 1. The fluid-tight attachment or bonding between the pouch 16 and the wings 28 may involve an adhesive, a melted thermoplastic, heat welding, ultrasonic welding, or other means for sealing the structures together.

The outer surfaces of walls 90 are formed with a mounting structure to which the pouch 16 may be attached. Along with wings 28, mounting structures provide surfaces to which the inner surfaces of pouch 16 may be connected to the spout 14 via a fluid-tight attachment.

Referring to FIGS. 4-6, in one embodiment mounting structure comprises a smoothly undulating, generally sinusoidal, wave-like pattern formed on/defined by the exterior surface of each of the first and second walls 90. Wave-like pattern extends along the height of the mounting portion 40 from the bottom to the top ends of walls 90.

As shown in FIGS. 4-6, the wave-like pattern formed on the exterior of walls 90 may include one or more peaks 93 that extend between wings 28, from the first edge to the second edge of each of the first and second walls 90. Adjacent peaks 93 are vertically separated from one another by troughs 94, which also extend between wings 28, from the first edge of the second edge of each of the first and second walls 90.

In some embodiments, walls 90 may be molded or otherwise formed such that the peaks 93 and troughs 94 defining the wave-like pattern are formed integrally and monolithically with the walls 90, with the wave-like pattern defining the exterior surfaces of walls 90. In other embodiments, discrete elements formed separately from the walls 90 may be attached to the exterior surfaces of walls 90 to form the wave-like pattern on the exterior surfaces of the walls 90.

Figure 7:
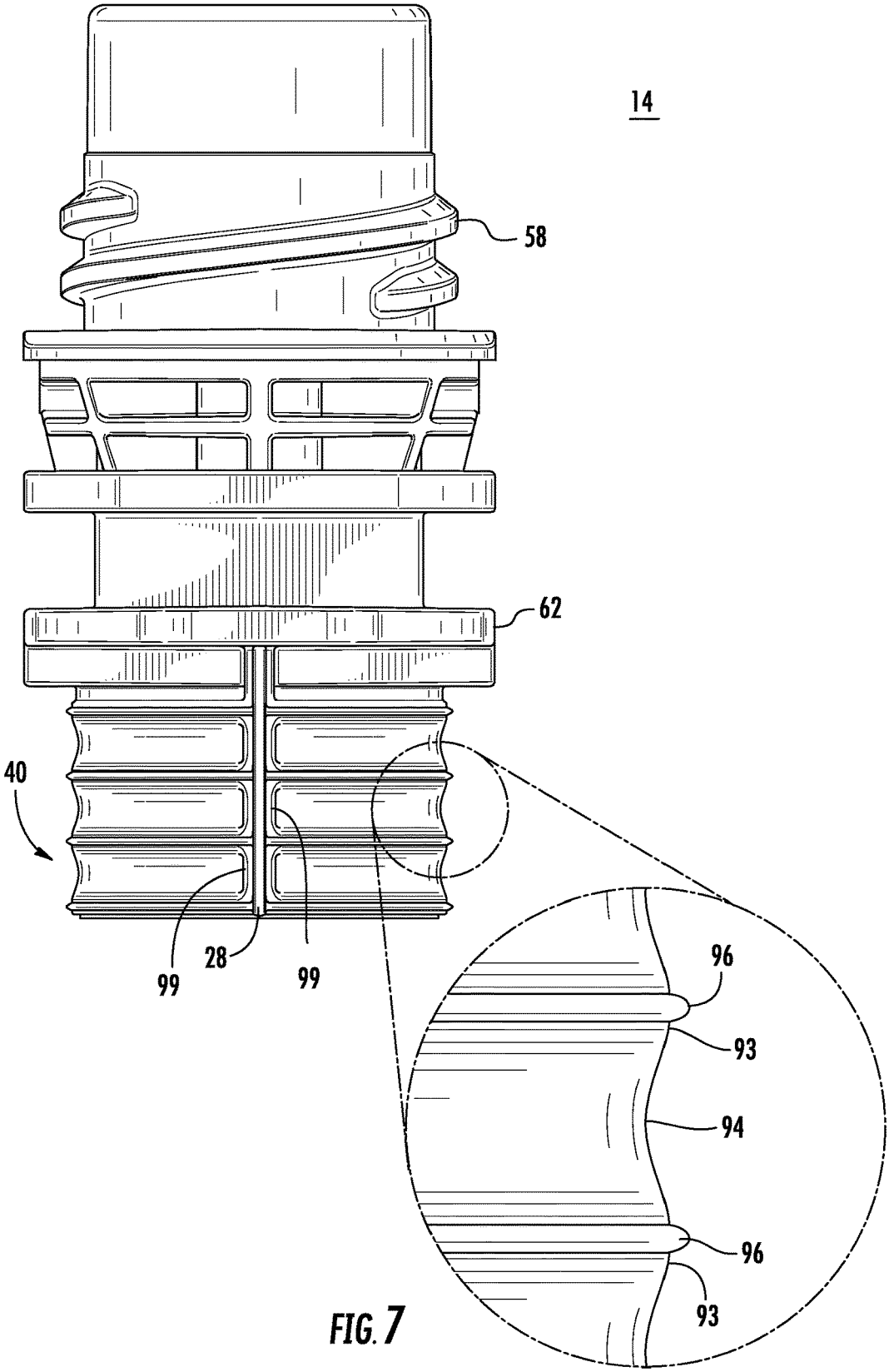
FIG. 7 is a side view of the spout of FIG. 4, as well as an enlarged view thereof.

In some embodiments, such as the embodiment of FIGS. 4-8, in which the pouch 16 and spout 14 are to be attached via welding, weld ribs or energy directors 96 may be provided along the crests of one or more peaks 93. Illustrated in FIG. 7 is an enlarged view of an embodiment of a mounting portion 40 formed with weld ribs 96 prior to attachment of the pouch 16 to the spout 14.

Figure 8:
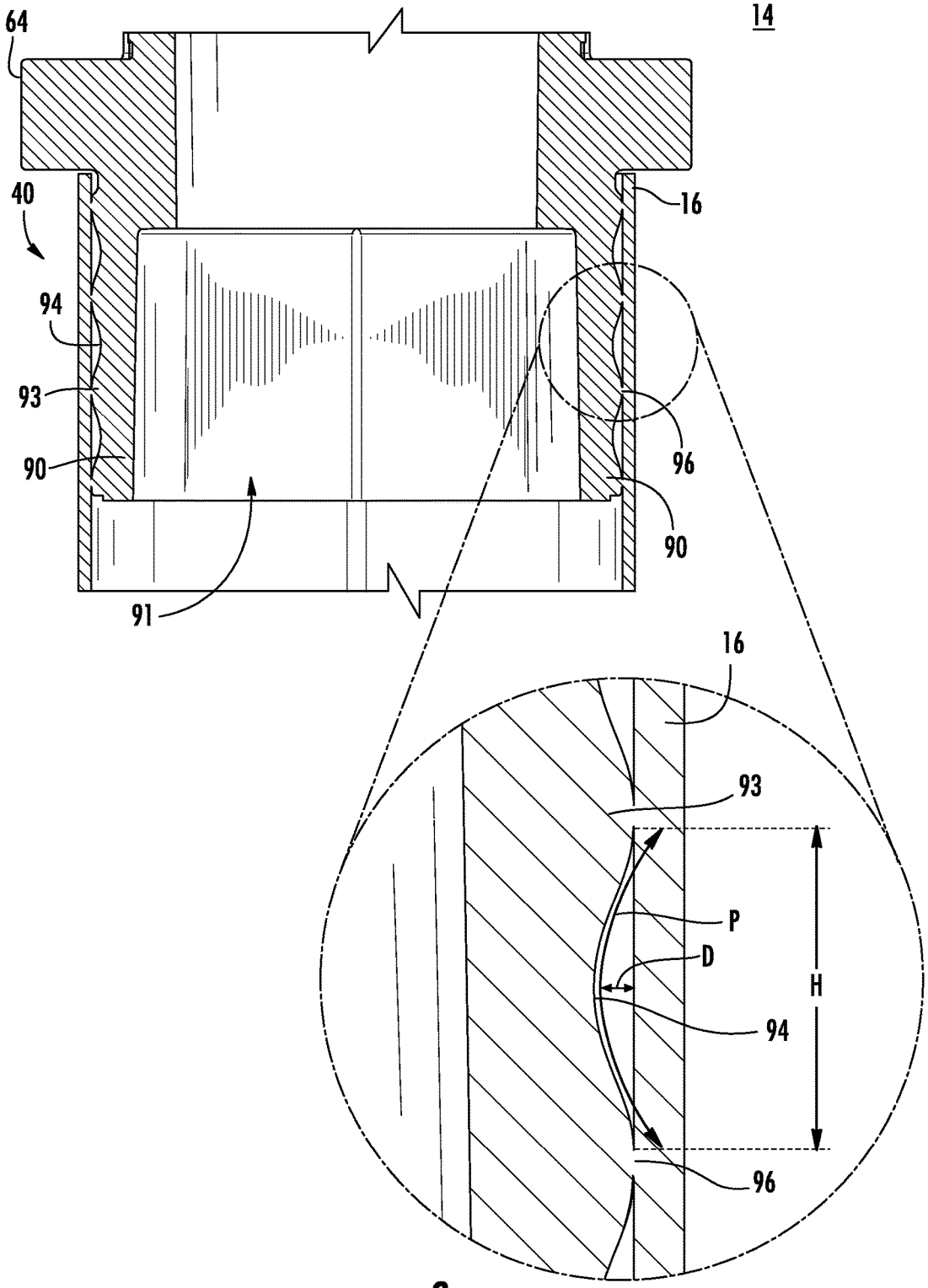
FIG. 8 is a cross-sectional side view of the spout of FIG. 4 attached to a pouch, as well as an enlarged view thereof.

As shown in FIG. 7, prior to attachment of the pouch 16 to the spout 14, weld ribs 96 protrude outwards from peaks 93. However, as shown in FIG. 8, once the pouch 16 has been welded to spout 14, the outwardly protruding structure of weld ribs 96 no longer defines a portion of the outer surface of walls 90. Instead, as illustrated in FIG. 8, once mounting portion 40 and pouch 16 have been welded together the walls 90 extend along a curved, generally sinusoidal wave-like pattern defined by peaks 93 and troughs 94 and which extends along the height of mounting portion 40.

Figure 9A:
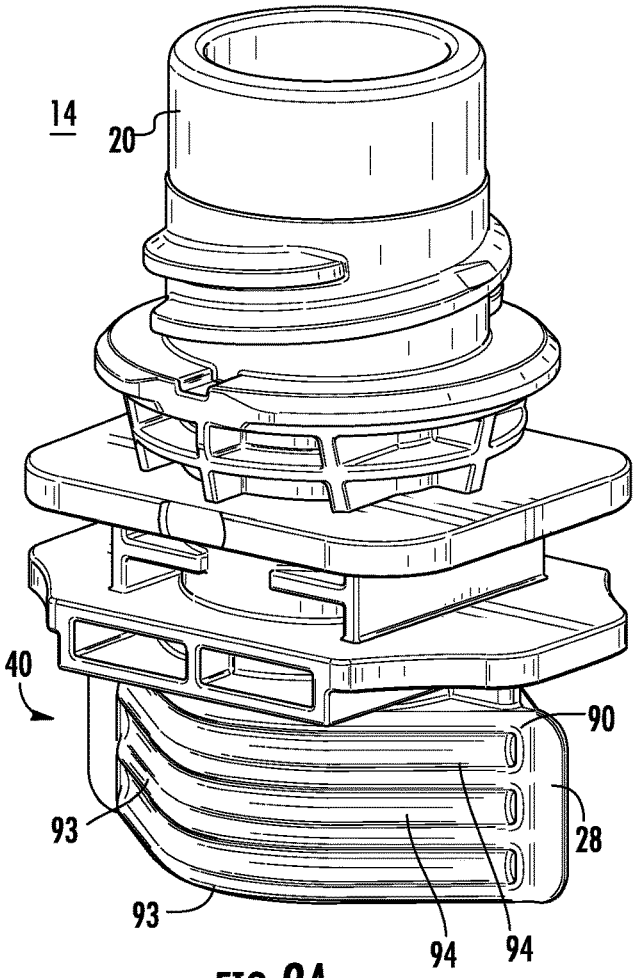
FIG. 9A is a top perspective view of a mounting portion of a spout according to an exemplary embodiment.

In other embodiments, pouch 16 and spout 14 may be attached via other connections besides welding. In embodiments which do not require weld ribs 96 to attach pouch 16 to spout 14, mounting portion 40 can be formed without weld ribs 96, e.g. as illustrated in the embodiment shown in FIGS. 9A and 9B. In some embodiments, e.g. where spout 14 and pouch 16 are to be attached via an adhesive connection, the crests of peaks 93 may be slightly flattened, such as illustrated in the embodiment of FIGS. 10A and 10B so as to provide a mounting surface 97 to which pouch 16 may be securely adhered.

When spout 14 and pouch 16 are assembled, pouch 16 is attached to the mounting portion 40 along the crests of peaks 93. Similar to a conventional mounting portion 140' (such as shown in FIGS. 2 and 3), once spout 14 and pouch 16 are assembled, spaces or cavities 190 are defined between the exterior surface of walls 90 of mounting portion 40 and the inner surfaces of pouch 16.

Similar to a container assembly 10' having a conventional mounting portion 140' (and as discussed with reference to FIGS. 2 and 3 above), under certain circumstances (e.g. changes in pressure) the pouch 16 may be forced inwards into cavities 190 defined by the mounting portion 40 of spout 14. As also described with reference to FIGS. 2 and 3, in some circumstances, such as e.g. during HPP, where the change in pressure is very large, the pouch 16 may be pushed so far into cavities 190 that the inner surface of pouch 16 is forced up against a majority or entirety of the exterior surface P of the mounting portion extending between adjacent points of attachment of the pouch 16 to the mounting portion.

However, in contrast to the damage that the cavities 190' of a conventional mounting portion 140' may cause when the forces acting on the outer surfaces of the pouch 16' exceed the forces acting on the inner surfaces of pouch 16', the cavities 190 of a mounting portion 40 according to any of FIGS. 4-12 do not result in similar stretching, distortion, or other damage to the pouch 16 and/or the attachment between the pouch 16 and spout 14 under similar conditions. Specifically, the wave-like pattern formed along the exterior surfaces of walls 90 of mounting portion 40 is configured to prevent or minimize any damage, stretching and/or other distortion of the pouch 16 in the event that external forces acting on the outer surfaces of the pouch 16 become greater than the forces acting on the inner surfaces of the pouch 16, e.g. such as would occur during HPP.

As noted above, when pouch 16 and spout 14 are attached, the pouch 16 is attached to mounting portion 40 along the crests of peaks 93. As shown in FIG. 8, the distance between crests of adjacent peaks 93 is defined by a height H. This distance H also corresponds to the length of the portion of the pouch 16 that extends between crests of adjacent peaks 93. With further reference to the enlarged portion of FIG. 8, the portion of the exterior surface of the wall 90 that extends from the crest of a first peak 93 along trough 94 to the crest of an adjacent peak 93 is defined by a length P.

In order to minimize possible damage to the pouch 16, the depth D of troughs 94 and the curvature of the wave-like pattern defined by peaks 93 and troughs 94 is configured such that the length P of the perimeter of the exterior surface of the mounting portion 40 extending between crests of adjacent peaks 93 is no more than 10% greater than the length H of the portion of the pouch 16 extending between adjacent peaks 93. More specifically, in one embodiment, the mounting portion 40 is configured such that the length of the perimeter P of the curve extending between crests of adjacent peaks 93 is only between 4 and 6% greater than the length H of the portion of pouch 16 extending between adjacent crests, and more specifically no more than 5% greater than H.

By limiting the ratio of the dimensions of P to be no greater than 10%, and more specifically between 4-6%, e.g. no more than 5% greater than the dimensions of H, the amount of the deformation or stretching of the pouch 16 and/or the damage to the attachment between spout 14 and pouch 14 that may occur under circumstances where the pouch 16 is forced inwards into cavities 190 are minimized.

In addition to the minimized P:H ratio, the mounting portion 40 may also include other features configured to minimize the risk of the pouch 16 being torn, ruptured, or otherwise deformed in the event that the sidewalls of the pouch 16 are collapsed into or occlude spaces 190.

In contrast to the angled, perpendicular configuration of ribs 145' as well as the arrangement of ribs 145' along the central structure 152' of a conventional mounting portion 140', the wave-like pattern extending along and defining outer surfaces of walls 90 of the mounting portion 40 of the various embodiments of FIGS. 4-12 provides a smooth, curved mounting portion 40 outer surface that is formed with minimal or no edges formed with sharp angles or small radii of curvature. As shown in FIGS. 4-6, the radii of curvature of the various structures formed on, defined by or extending from the mounting portion 40, such as e.g. peaks 93, are formed having relatively large radii of curvature.

Figure 9B:
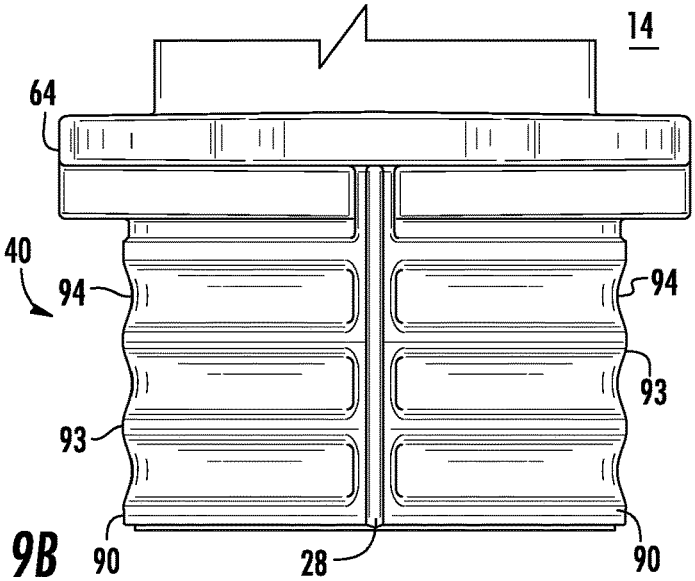
FIG. 9B is side view of the mounting portion of FIG. 9A.
Figure 10A:
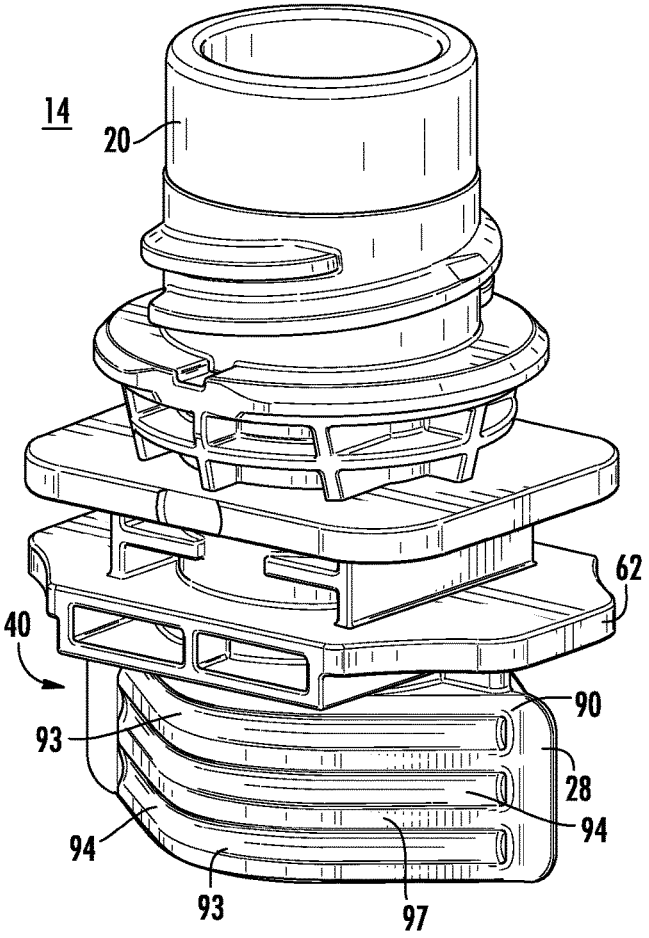
FIG. 10A is a top perspective view of a mounting portion of a spout according to an exemplary embodiment.
Figure 10B:
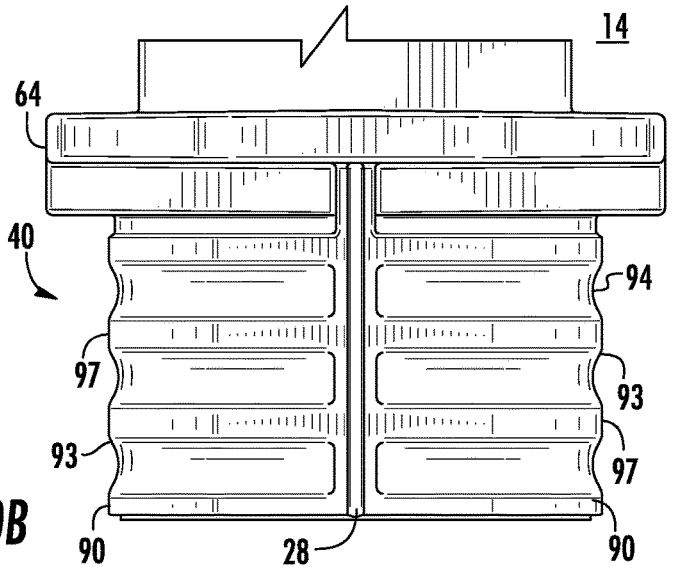
FIG. 10B is side view of the mounting portion of FIG. 10A.

As illustrated by the exemplary embodiments of FIGS. 8 and 9B, adjacent peaks 93 and troughs 94 forming the wave-like pattern of walls 90 transition between one another along the height of the mounting portion 40 along continuous, smooth, gently curved surfaces having relatively large radii of curvature. Even in embodiments, such as e.g. shown in FIG. 10B, where the peaks 93 of mounting portion 40 may include flat vertical portions (e.g. mounting surfaces 97), such flat portions transition into the adjoining curved vertical surfaces along gentle curves instead of along sharp angles. Similarly, as shown in FIGS. 5, 9A and 10A, the horizontally spaced ends 99 of peaks 93 and troughs 94 transition into the wings 28 of mounting portion 40 along smooth, generally curved surfaces.

By minimizing or eliminating sharp edges and angled structures and/or edges or structures having small radii of curvature from the structure of the mounting portion 40, potential stress concentrations along the mounting portion 40 are minimized. As such, the risk of elastic or permanent deflection of the material of the pouch 16, as well as the risk that the pouch 16 will snag, rupture, tear or otherwise fail as the pouch 16 moves relative the outer surface of mounting portion 40 is minimized or even prevented. Thus, in the event that pouch 16 may be forced into cavities 190 (such as may occur, e.g. during HPP), the geometry and configuration of the exterior of mounting portion 40 will minimize or prevent any damage that might otherwise occur if the pouch 16 were stretched across stress raisers, such as e.g. the angled surfaces or edges of a conventional mounting portion 140'. As such, the mounting portion 40 is configured to prevent damage such as illustrated for example in the enlarged view of FIG. 3.

Figure 11:
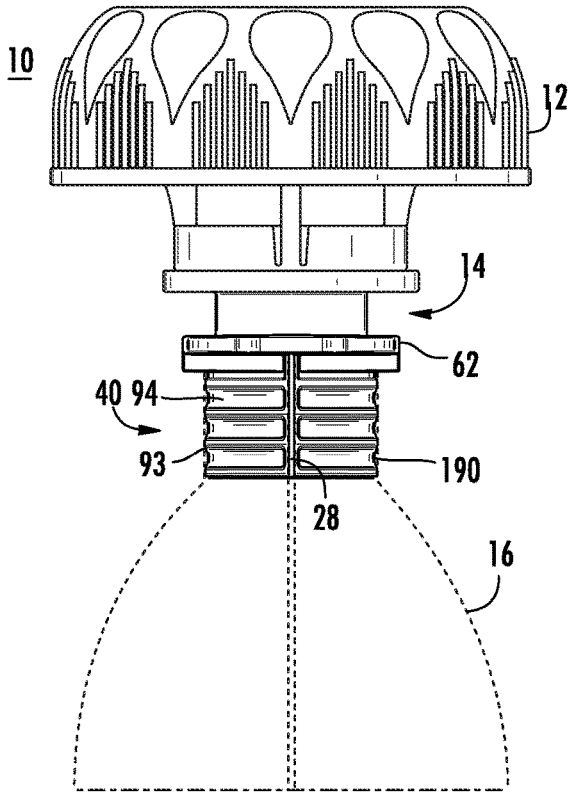
FIG. 11 is a side view of a container assembly having a spout as shown in FIG. 4; prior to undergoing high pressure processing, according to an exemplary embodiment.
Figure 12:
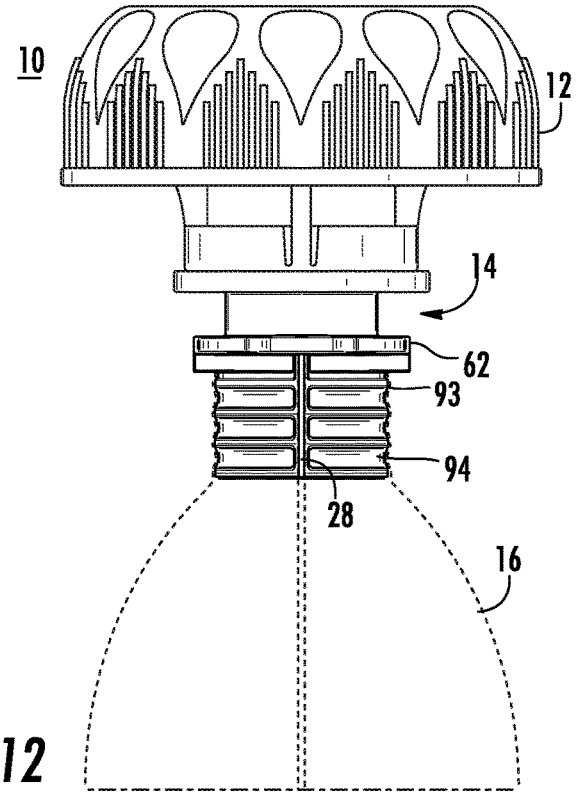
FIG. 12 is a side view of the container assembly of FIG. 11 undergoing high pressure processing, as well as an enlarged view thereof.

Shown in FIG. 11 is a container assembly 10 having a mounting portion 40 as described with reference to FIGS. 4-10B in an initial, unstressed state. In FIG. 12, the container assembly of FIG. 11 is shown undergoing HPP. As seen in FIG. 12, the increased pressure of the HPP process may result in the pouch 16 being pushed inwards into cavities 190. However, because of the minimal P:H ratio, the amount that the pouch 16 is stretched as it is collapsed by the increased pressure into cavities 190 is limited to no more than 10%, and more preferably no more than 4-6%, or more specifically no more than 5%, thereby limiting damage to the pouch 16. Furthermore, because of the curved exterior surface of mounting portion 40, no tearing or rupturing of the pouch 16 occurs as the pouch 16 is pushed into cavities.

In contrast to the damage to the pouch 16' and attachment between the pouch 16' and spout 14' that occurs to a container assembly 10' having a conventional mounting portion 140' during HPP as a result of the sharp, angled exterior surfaces and the large P':H' ratio of the conventional mounting portion 140' (as illustrated e.g. in FIG. 3), as shown in FIG. 12, the distortion to pouch 16 and the attachment of the pouch 16 to spout 14 of a container assembly 10 having a modified mounting portion 40 formed with no or minimal structures that may act as stress raisers is minimal, even during HPP.

As discussed above, in additional to incorporating a modified mounting portion 40 such as described with reference to FIGS. 4-12, container assembly 10 may also comprise one or more vents configured to prevent damage to the pouch 16 and/or the connection between the pouch 16 and spout 14 resulting from changes in temperature and/or pressure and/or from external forces that may be applied to the container assembly 10. Referring to FIGS. 13-33, various embodiments of such vents that may be incorporated into container assembly 10 are shown. The vent configurations illustrated in and described with reference to FIGS. 13-33 are shown as being incorporated into mounting portions 140 instead of being incorporated into modified mounting portions 40 such as shown in and described with reference to FIGS. 4-12. However, it is to be understood that the vent structures shown in any of FIGS. 13-33 may similarly be incorporated into a modified mounting portion 40 as shown in as described with reference to FIGS. 4-12.

As shown in FIGS. 13-33, a container assembly 10 formed with vent features may include a mounting portion 140 having a structure that in many ways is similar to the structure of a conventional mounting portion (e.g., the mounting portion 140' illustrated in and described with reference to FIGS. 2 and 3). For example, similar to the conventional mounting portion 140' of FIGS. 2 and 3, mounting portion 140 may comprise a plurality of ribs 145 and a bottom sealing wall 143 extending horizontally and radially outwards from a central structure 152. The ribs 145 and bottom sealing wall 143 have outer surfaces 148 to which the inner surfaces of a pouch 16 are sealed to form container assembly 10.

As described above with reference to FIGS. 2 and 3, in container assemblies 10' having conventional mounting portions 140', when the pouch 16' and conventional mounting portion 140' are assembled, cavities 190' are defined between adjacent ribs 145'; bottommost rib 145' and bottom sealing wall 143'; exterior of central structure 152' and the interior surface of pouch 16'. In such container assemblies 10' having conventional mounting portions 140', there is no fluid communication between the interior of the cavities 190' and the exterior environment. Thus, when there are differences between the pressure within cavities 190' and the pressure of the ambient environment, damage to the pouch 16' and/or the connection between spout 14' and pouch 16' may occur as a result of pouch 16' being pushed into cavities 190'.

Similar to container assemblies 10' having conventional mounting portions 140', cavities 190 are also defined between adjacent ribs 145; bottommost rib 145 and bottom sealing wall 143; exterior of central structure 152 and the interior surface of pouch 16. However, in contrast to container assemblies 10', the vents of container assemblies 10 incorporating vents (such as, e.g. those described in the exemplary embodiments of FIGS. 13-33) provide fluid communication between the interiors of cavities 190 and the exterior environment. As the vents allow air to travel between the cavities 190 of the mounting portion 140 and the ambient environment, the internal pressure within spaces 190 may be equalized with the pressure external to the container assembly 10.

By allowing for the pressure inside the spaces 190 to be substantially the same as the pressure external to the container assembly 10, the vents are configured to prevent pouch 16 from occluding cavities 190. Thus, even though the structure (e.g. spacing of ribs 145 and the angled, sharp edges of ribs 145) of mounting portion 140 may be similar to the structure of conventional mounting portion 140', because the vents prevent pouch 16 from being pushed into cavities 190 and/or stretched over the edges of ribs 145, these similar mounting portion 140 structures do not result in the damage to the container assembly 10 that would otherwise occur in a non-vented container assembly 10' having a conventional mounting portion 140' (e.g. as shown in FIG. 3).

Figure 13:
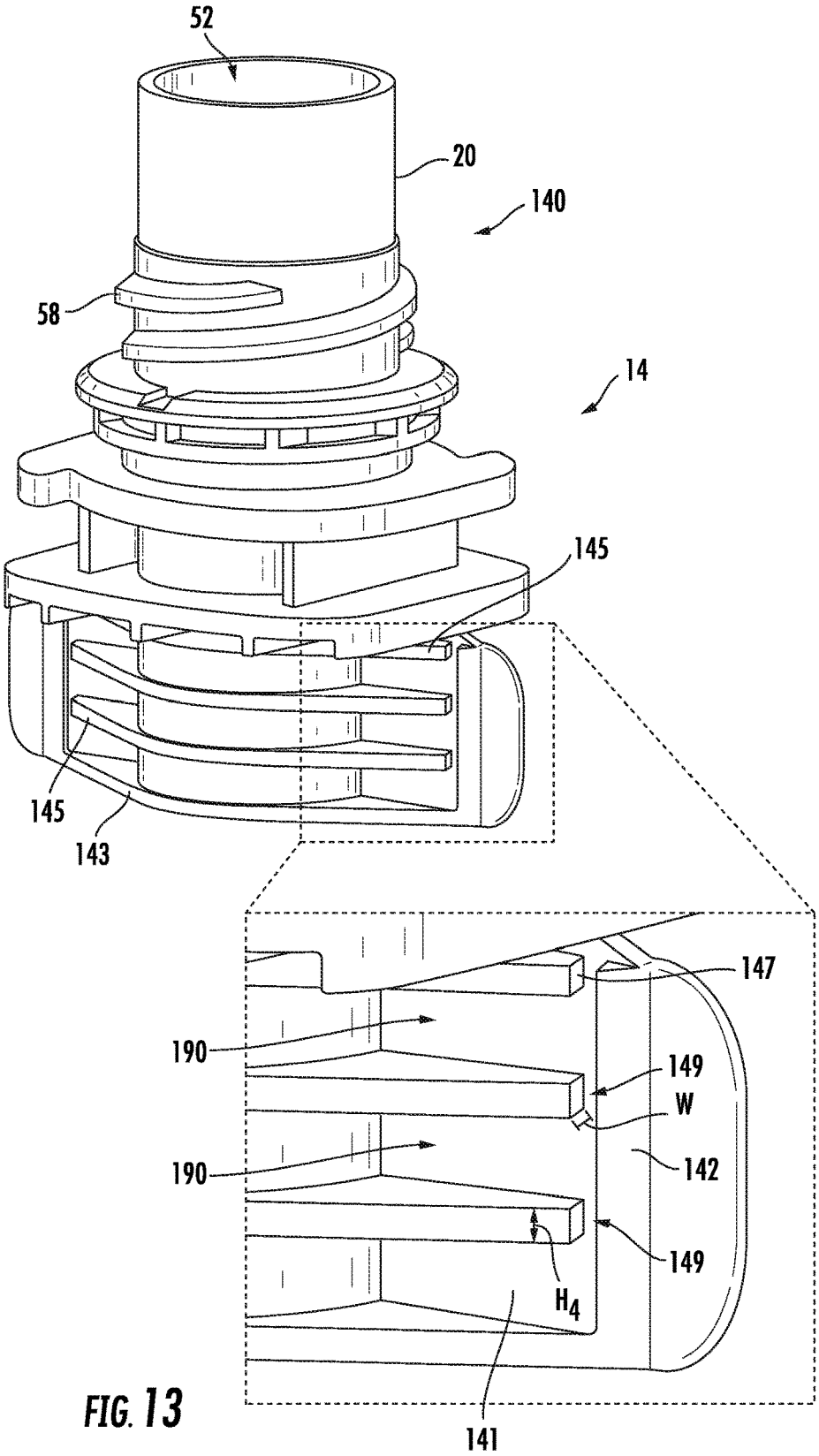
FIG. 13 is a perspective view of a spout including a mounting portion having a vent according to an exemplary embodiment, as well as an enlarged view thereof.
Figure 14:
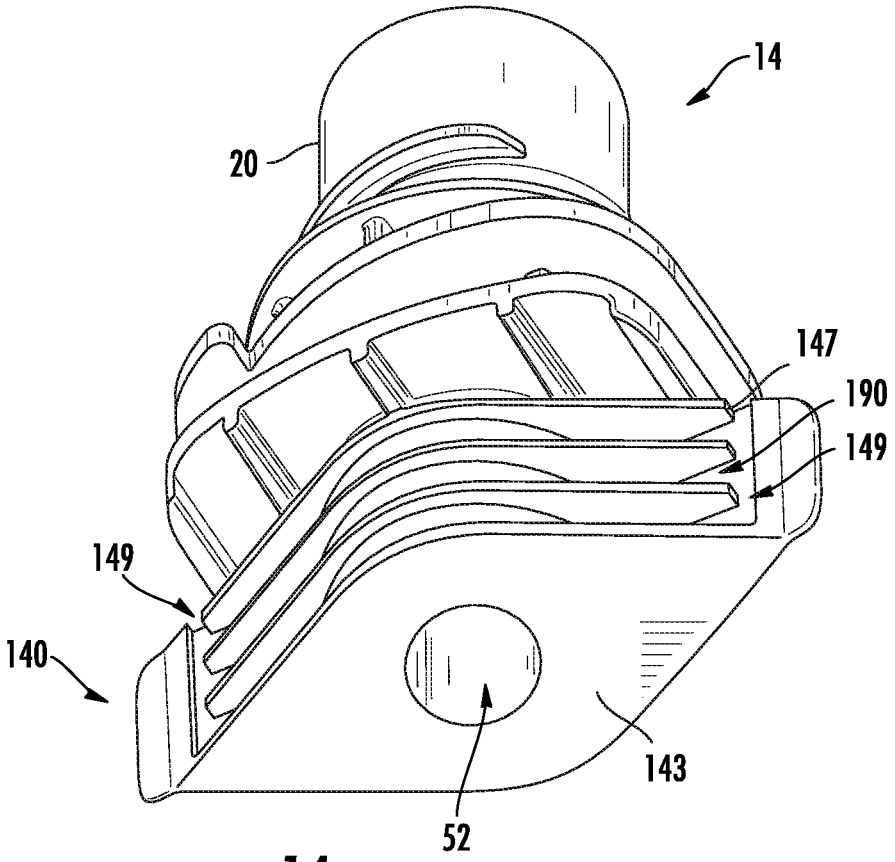
FIG. 14 is bottom perspective view of the spout of FIG. 13.
Figure 15:
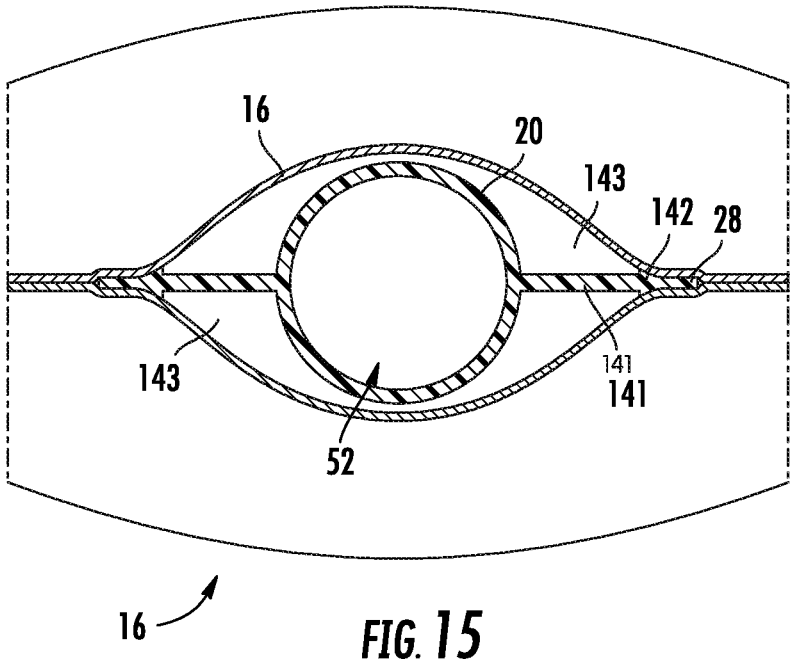
FIG. 15 is a sectional view from above taken along line 15-15 of FIG. 1 according to one embodiment.
Figure 17:
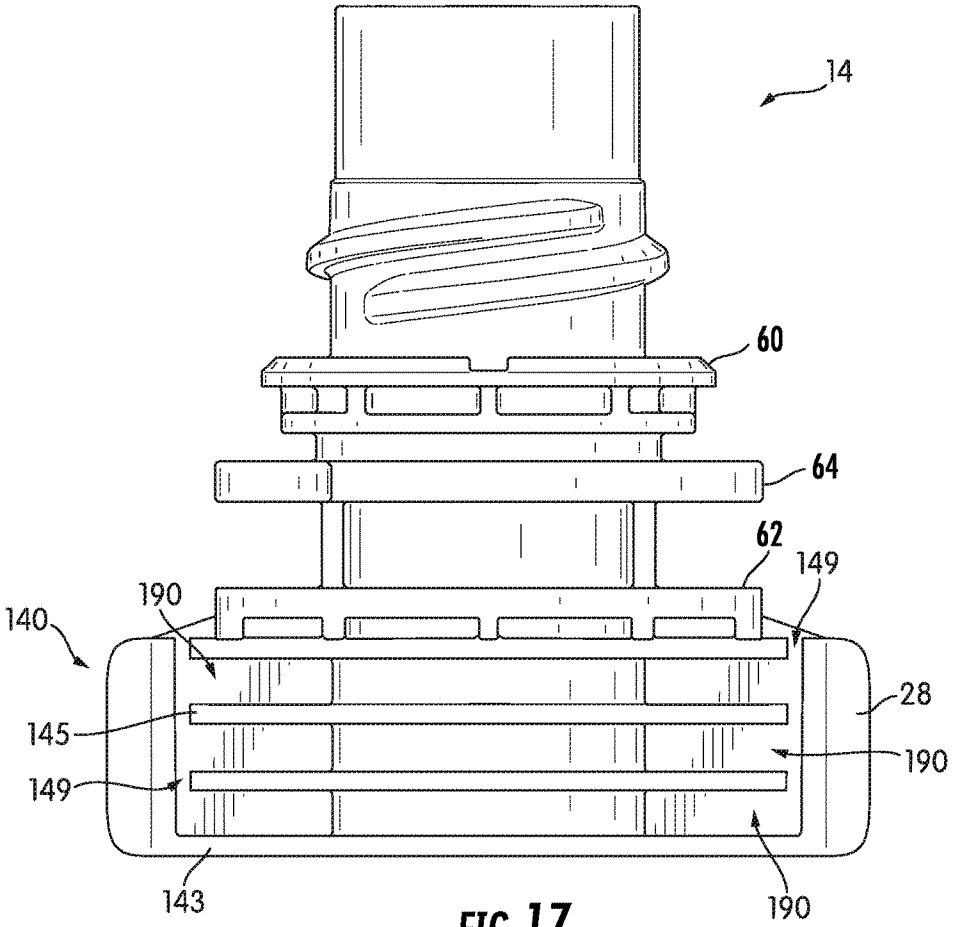
FIG. 17 is a front view of the spout of FIG. 13.
Figure 16:
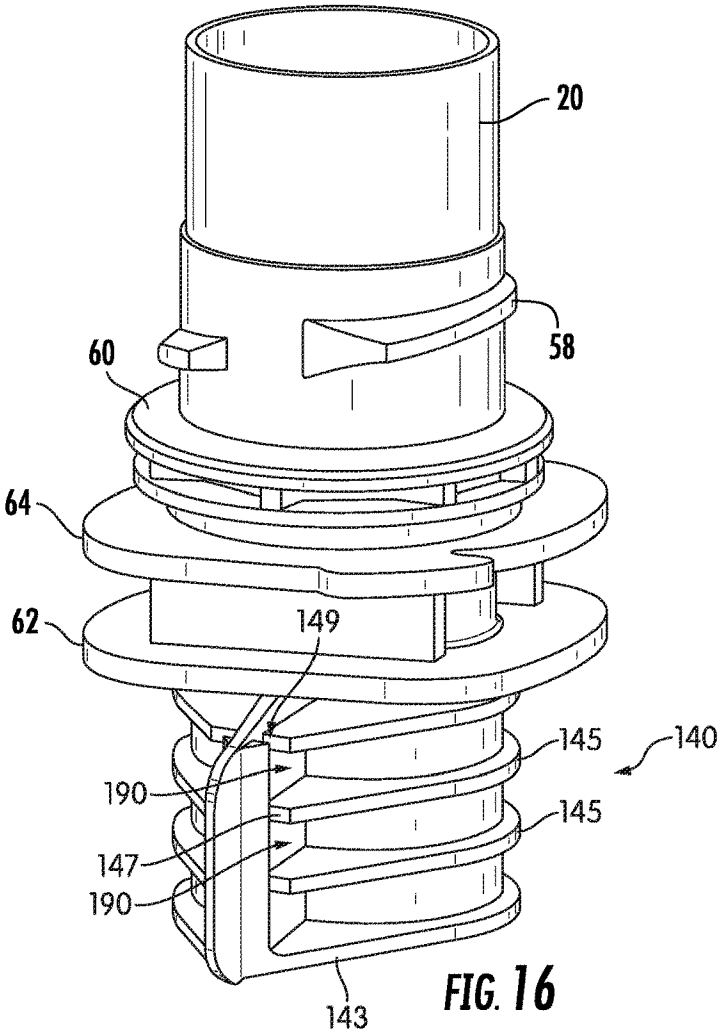
FIG. 16 is a perspective view of the spout of FIG. 13.
Figure 18:
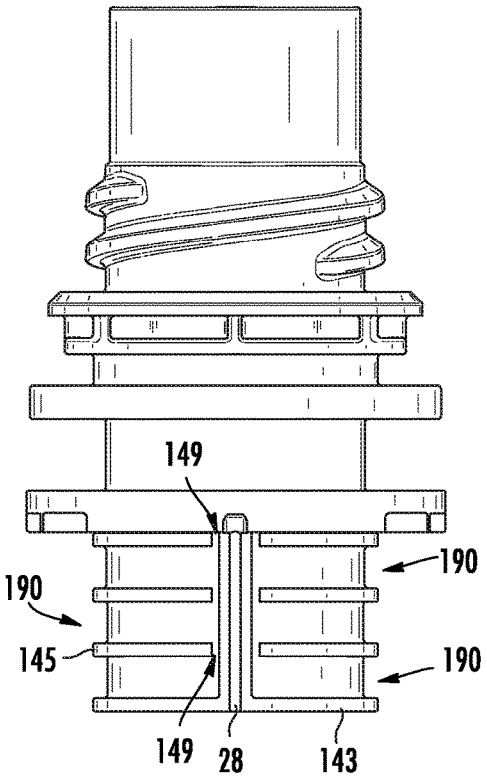
FIG. 18 is a side view of the spout of FIG. 13.

Referring to FIGS. 13-20, one embodiment of a spout 14 incorporating vents is shown. As shown in FIGS. 13 and 14, the shape, size and configuration of ribs 145 generally mirrors the shape and configuration of bottom sealing wall 143. However, whereas the bottom sealing wall 143 extends from one wing 28 to opposite wing 28, such as illustrated in FIG. 15, the ends of ribs 145 are cut short, creating a gap 149 between end portions 147 of ribs 145 and the wings 28 to ribs 145. Because the ribs 145 are cut short, end portions 147 are defined by rectangular faces having a height H4 and width W.

Figure 19:
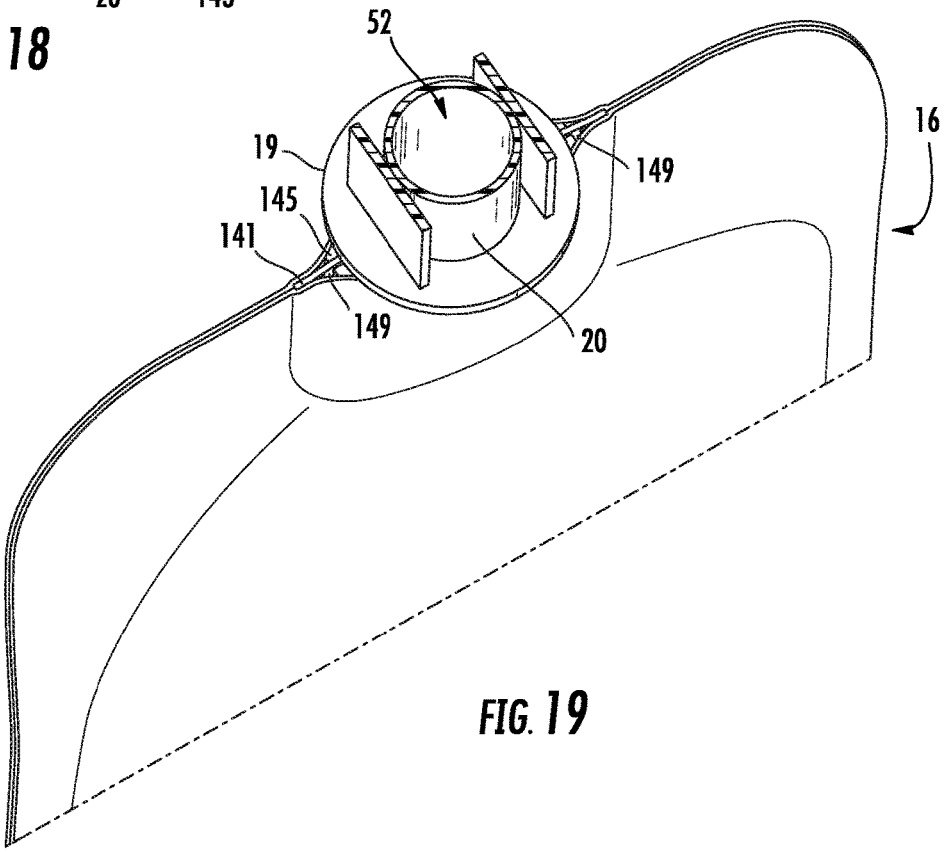
FIG. 19 is a perspective sectional view from above taken along line 19-19 of FIG. 1 according to an exemplary embodiment.
Figure 20:
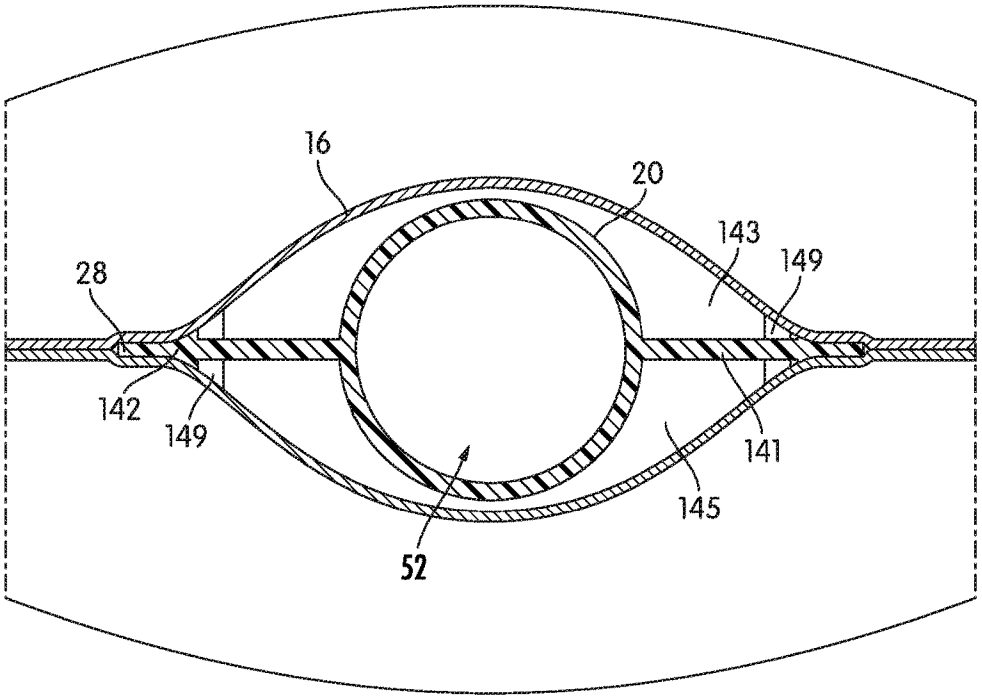
FIG. 20 is a sectional view from below taken along line 20-20 of FIG. 1 according to one embodiment.

As shown in FIGS. 19 and 20, when the pouch 16 and spout 14 are attached, gaps 149 define vents through which the spaces 190 are in fluid communication with the outside environment. As shown in FIGS. 14, 15 and 20, wings 28 may optionally include transition portions 142 that extend along a curve from the flat portion of wings 28. The outer perimeters of ribs 145 are configured to form a fluid-tight interface with the pouch 16 when the pouch 16 is attached to the ribs 145 of mounting portion 140. This fluid-tight attachment or bonding between the pouch 16 and the ribs 145 may involve an adhesive, a melted thermoplastic, heat welding, ultrasonic welding, or other means for sealing the structures together.

As shown in FIG. 20, the outer perimeter of each rib 145 is configured to form an uninterrupted fluid-tight interface along the entire length of each rib 145 with the inner surfaces of the sidewalls of pouch 16 when the pouch 16 and spout 14 are attached. The structure of the end portions 147 and the curve of the transition portion 142 are configured such that when the pouch 16 and spout 14 are sealed together, the pouch 16 lays taut against the outer perimeter of the mounting portion 140 and the pouch is prevented from occluding gaps 149.

Figure 21:
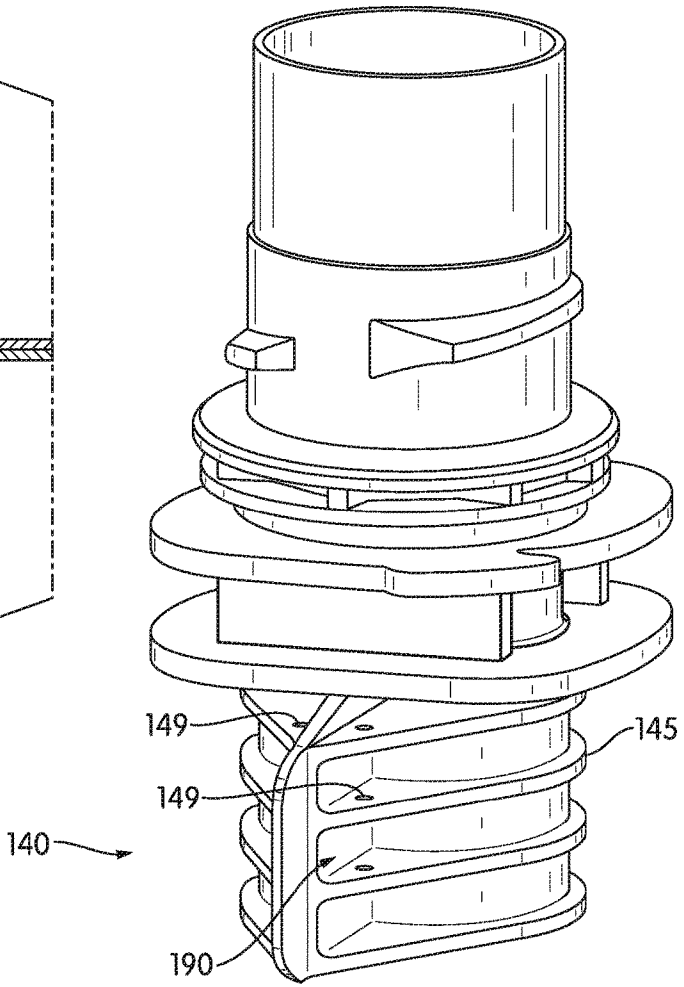
FIG. 21 is a perspective view of a spout including a mounting portion having a vent according to an exemplary embodiment.
Figure 24:
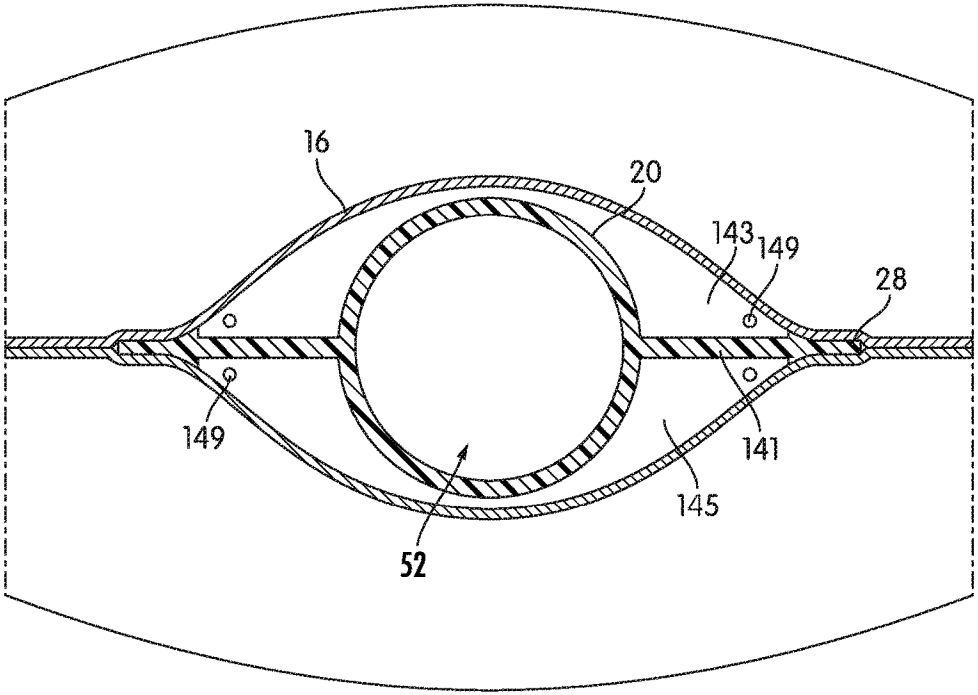
FIG. 24 is a sectional view from below taken along line 24-24 of FIG. 1 according to one embodiment.

Referring to FIGS. 21-24, another embodiment of a spout incorporating a venting feature is shown. As shown in FIG. 21 the shape, size and configuration of ribs 145 generally mirrors the shape, size and configuration of bottom sealing wall 143. Also, as seen in FIG. 24, similar to the uninterrupted perimeter of the bottom sealing wall 143, the perimeter of the ribs 145 is uninterrupted, allowing the pouch 16 to form an uninterrupted fluid tight seal along the entirety of the perimeter of the ribs 145 from one wing 28 to opposite wing 28. This fluid-tight attachment or bonding between the pouch 16 and the ribs 145 may involve an adhesive, a melted thermoplastic, heat welding, ultrasonic welding, or other means for sealing the structures together.

Figure 22:
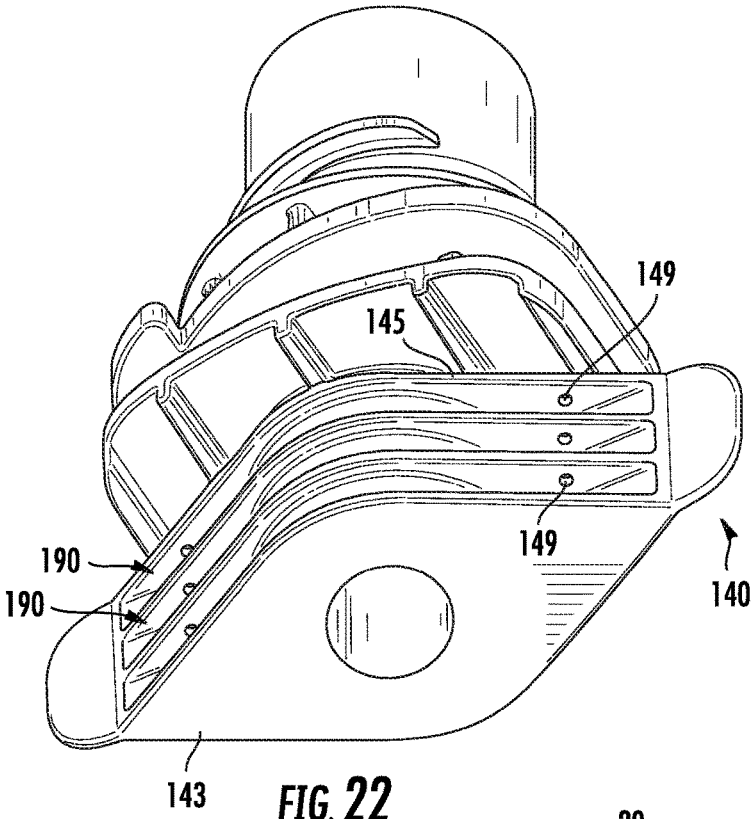
FIG. 22 is a bottom perspective view of the spout of FIG. 21.
Figure 23:
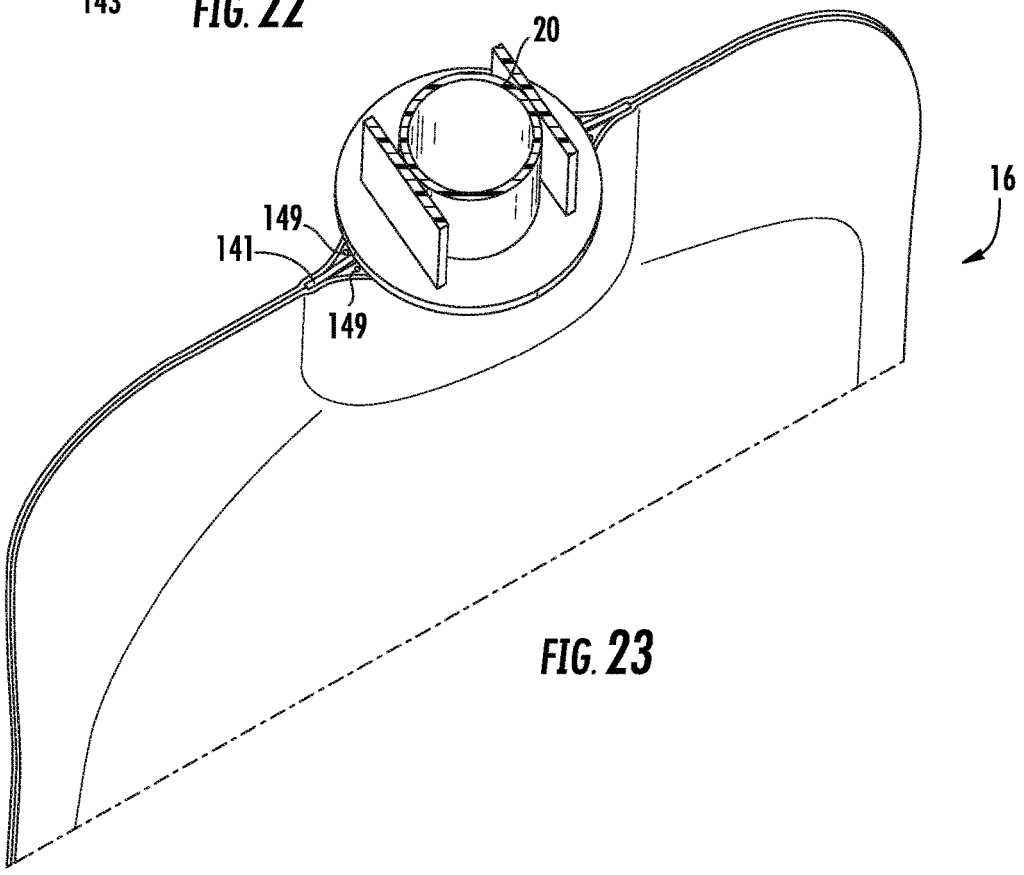
FIG. 23 is a perspective sectional view from above taken along line 23-23 of FIG. 1 according to one embodiment.

As shown in FIG. 22, extending through each rib 145 from a top surface to a bottom surface of each rib 145 is a gap 149, formed as a hole or aperture extending from a top surface of each rib 145 to a bottom surface of each rib. As shown in FIG. 22, gaps 149 define vents which permit fluid communication between inner spaces 190 and the outside environment after the pouch and mounting portion 140 have been attached. The holes or apertures in ribs 145 forming gaps 149 can be formed in ribs 145 prior to attachment of spout 14 to pouch 16. In other embodiments, gaps 149 can be formed in ribs 145 after spout 14 and pouch 16 have been attached. Although in FIGS. 21-24 gaps 149 are illustrated as round holes, gaps 149 may have any shape or cross-section and the dimensions of gaps 149 may vary from those shown in the figures.

Figure 25:
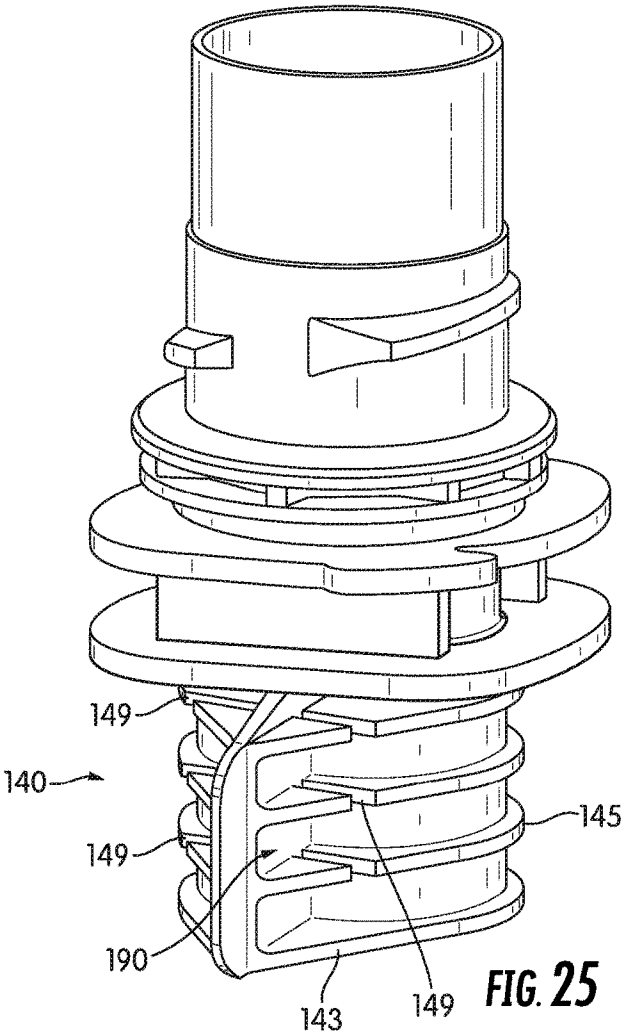
FIG. 25 is a perspective view of a spout including a mounting portion having a vent according to an exemplary embodiment.
Figure 26:
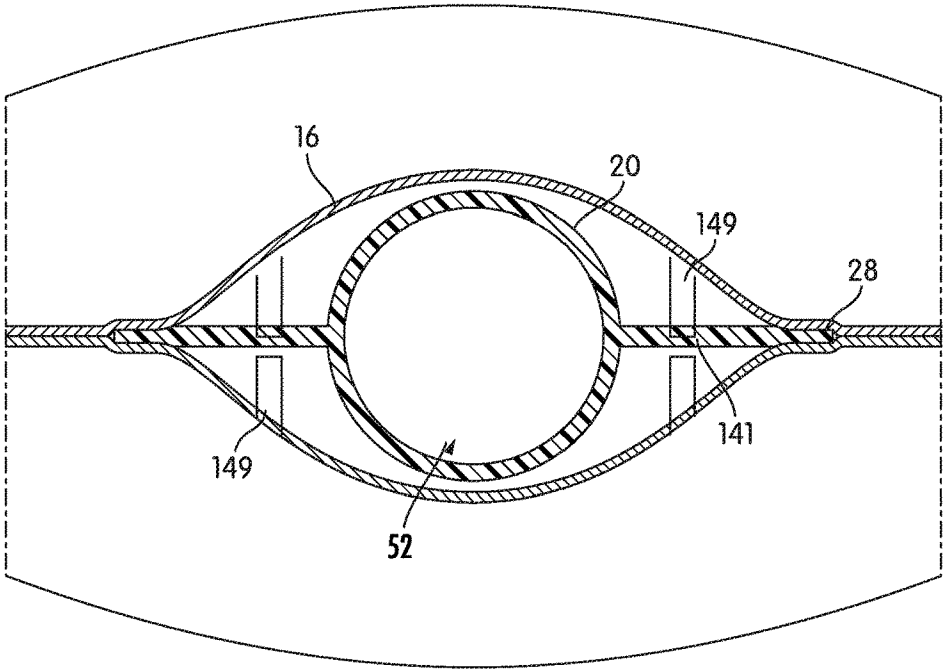
FIG. 26 is a sectional view from below taken along line 26-26 of FIG. 1 according to one embodiment.

Referring to FIGS. 25 and 26, another embodiment of a spout 14 incorporating a vent is shown. As shown in FIG. 25, the shape, size and configuration of ribs 145 generally mirrors the shape, size and configuration of bottom sealing wall 143. As illustrated by FIG. 25, in this embodiment ribs 145 extend between wings 28, similar to bottom sealing wall 143. However, as shown in FIG. 26, unlike the bottom sealing wall 143, which has an uninterrupted outer perimeter (as shown in FIG. 15), the outer perimeter of ribs 145 is interrupted by gaps 149. The gaps 149 formed in the perimeter of ribs 145 extend from a bottom surface to a top surface of each rib 145. In FIG. 25 and FIG. 26 gaps 149 are shown as extending through the ribs 149 from the outer perimeter of ribs 145 to the support wall 141. However, in other embodiments gaps 149 may extend through the ribs 145 from the outer perimeter of ribs 145 to a depth that does not extend all the way to support wall 141. Gaps 149 may be formed along any portion of ribs 145 between first and second wings 28. Also, although in FIGS. 25 and 26 gaps 149 are illustrated as having a generally rectangular shape, gaps 149 may have any shape or cross-section and the dimensions of gaps 149 may vary from those shown in the figures.

As seen in FIG. 26, because gaps 149 are formed in the outer perimeter of ribs 145, the interface between the inner surfaces of the sidewalls of the pouch 16 and the ribs 145 is interrupted along those portions of the length of the ribs 145 at which gaps 149 are formed in the ribs 145. As also seen in FIG. 26, at those portions at which the outer perimeter of ribs 145 is in contact with the inner surfaces of the sidewalls of pouch 16, the outer perimeters of ribs 145 are configured to form a fluid-tight interface with the inner surfaces of the sidewalls of pouch 16. This fluid-tight attachment or bonding between the pouch 16 and the ribs 145 may involve an adhesive, a melted thermoplastic, heat welding, ultrasonic welding, or other means for sealing the structures together.

As seen in FIG. 26, at those portions along the length of ribs 145 at which gaps 149 are formed, the pouch 16 is attached to mounting portion 140 such that the pouch 16 lays taut against the outer perimeter of the mounting portion 140 so as to prevent the pouch from occluding gaps 149 and to allow for fluid communication between spaces 190 and the outside environment.

Figure 27:
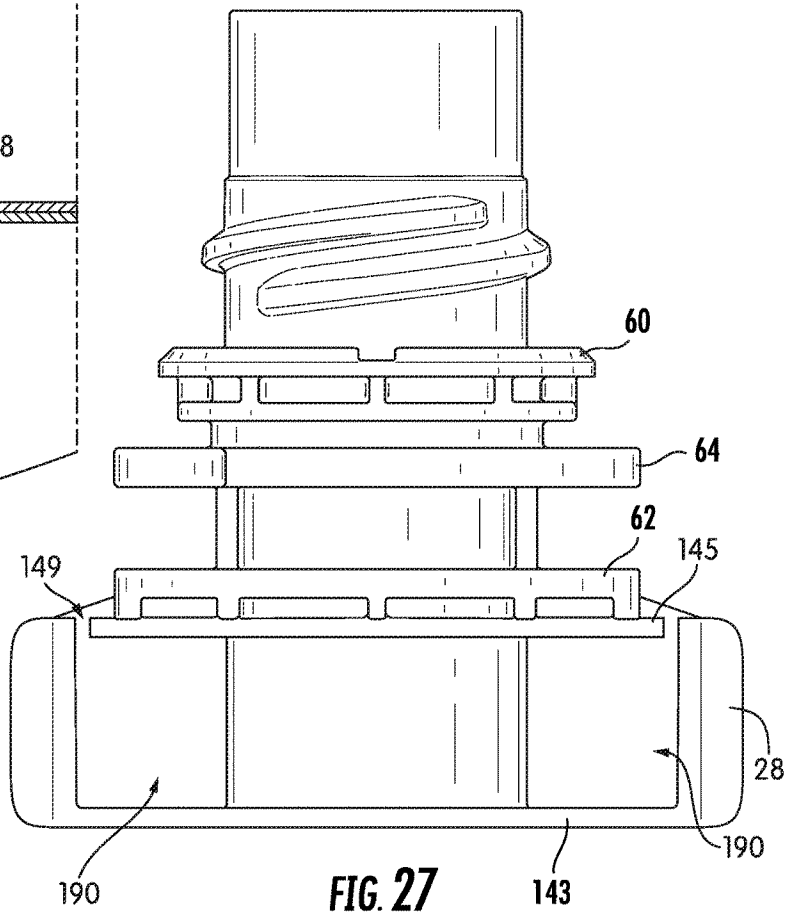
FIG. 27 is a front perspective view of a spout including a mounting portion having a vent according to an exemplary embodiment.

As illustrated by the various embodiments discussed above, spout 14 may include multiple ribs 145. Alternatively, in other embodiments, a spout 14 incorporating vents as shown in any of these embodiments may include only a single rib 145. Shown in FIG. 27 is one embodiment of a spout 14 including a single rib 145. The structure and configuration of the rib 145 and the corresponding vent formed by gaps 149 in the embodiment shown in FIG. 27 is similar to the structure and configuration of the ribs 145 and the corresponding vents formed by gaps 149 in the embodiment shown in FIG. 13. However, whereas in FIG. 13 the mounting portion 140 is illustrated as including three ribs, as seen in FIG. 27, the mounting portion includes a single rib 145. Although FIG. 27 illustrates an embodiment of a spout having only a single rib 145 and having a mounting portion 140 including a vent structure similar to the vent structure disclosed with reference to the embodiment of FIG. 13 discussed above, the use of a single rib 145 may be incorporated into any of the embodiments of the mounting portion 140 having a vent structure as discussed herein.

Figure 28:
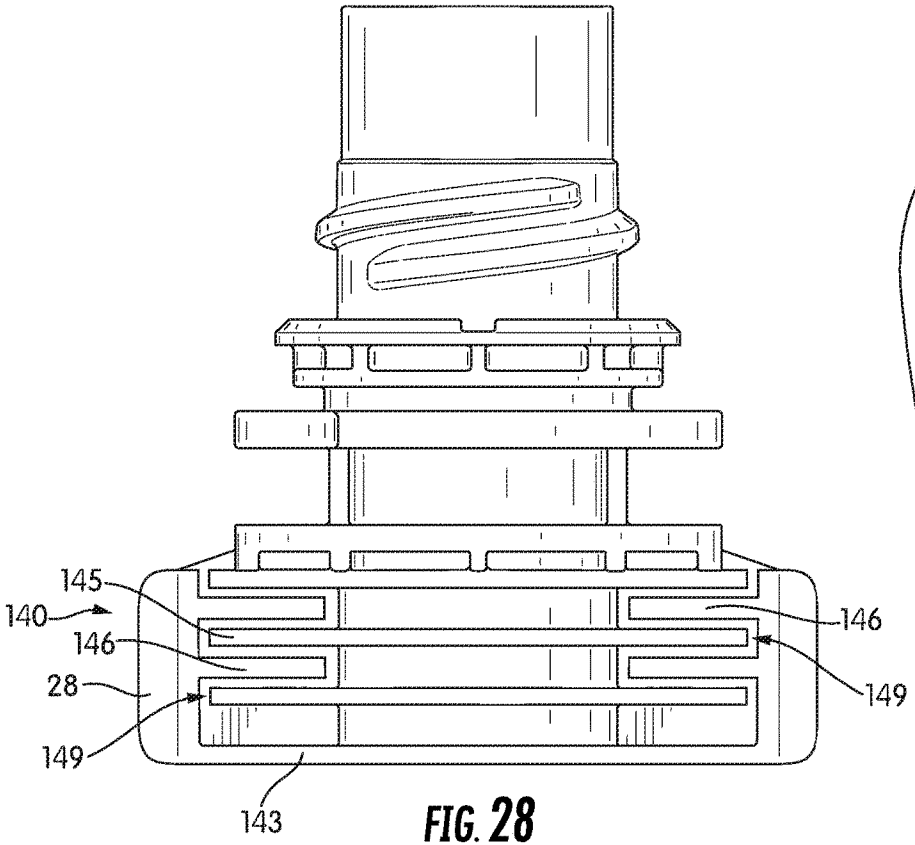
FIG. 28 is a front perspective view of a spout including a mounting portion having a vent according to an exemplary embodiment.

As shown in FIG. 28, a spout 10 incorporating a venting feature as shown in any of the embodiments disclosed herein may also include one or more side projections 146. Although FIG. 28 illustrates an embodiment of a spout incorporating side projections 146 having a mounting portion 140 including a vent structure similar to the vent structure disclosed with reference to the embodiment of FIG. 13 discussed above, side projections 146 may be incorporated into any of the embodiments of a mounting portion 140 having a vent structure as discussed herein.

Referring to FIG. 28, side projections 146 may be configured to provide a greater surface area against which to seal the pouch 16, allowing for a more secure attachment of the spout 14 to the pouch 16. Also, side projections 146 may be configured to strengthen and prevent distortion and/or damage to the spout 14 and to prevent damage to or accidental rupturing of the pouch 16 after the pouch 16 and spout 14 have been attached.

As shown in FIG. 28, in some embodiments side projections 146 project inwardly from wings 28. In other embodiments, side projections 146 may extend perpendicularly outward from support wall 141 or radially outward from tube 20. Side projections 146 may be spaced in between adjacent ribs 145, and the outer perimeter of the side projections 146 may generally mirror the shape, size and configuration of the bottom sealing wall 143 and/or the ribs 145. Although two side projections 146 are shown extending from each surface of both wings 28 in the embodiment shown in FIG. 28, in other embodiments the number and positioning of side projections 146 may vary.

In one embodiment, not shown, side projection 146 may include a single side projection 146 having a height substantially similar to the height of wings 28 and extending from one wing 28 to the opposite wing 28 on both the front and rear sides of the mounting portion 140. In such an embodiment, the side projection 146 may form an annular wall which circumferentially surrounds the entire outer perimeter of ribs 145 around both the front and rear of the mounting portion 140. In such an embodiment, the side projection 146 may be configured to maximize the surface area of the mounting portion 140 to which the pouch 16 may be sealed. In some embodiments, the entirety of the bottom perimeter of the side projection may be attached to and circumferentially surround the upper surface of bottom sealing wall 143. In other embodiments, the side projection 146 may be attached to the mounting portion 140 only at wings 28. A mounting portion 140 having such a side projection 146 may be incorporated into the structure of any of the mounting portions 140 disclosed herein.

Figure 29:
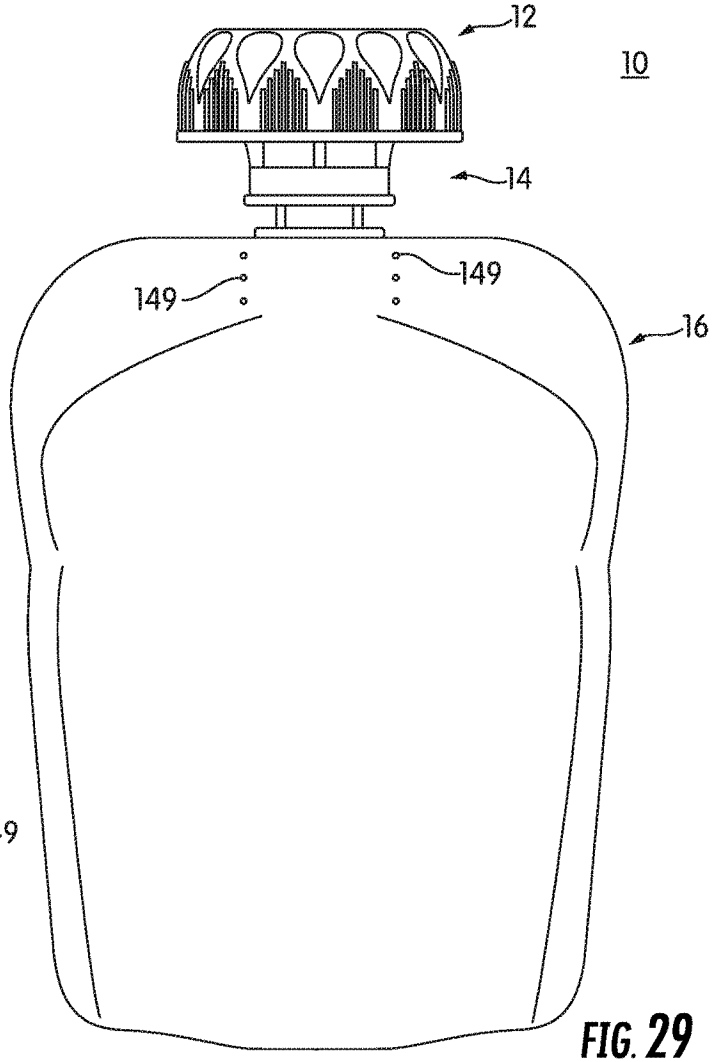
FIG. 29 shows a container assembly including a pouch having a vent feature according to an exemplary embodiment.
Figure 30:
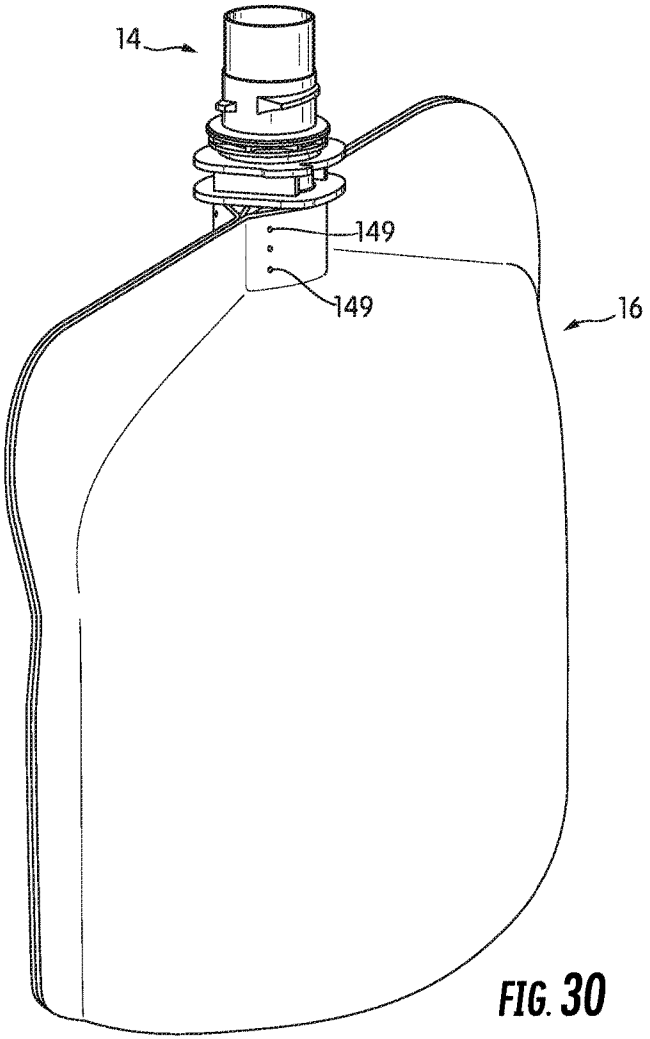
FIG. 30 is a perspective view of the container assembly of FIG. 29.

Referring to FIGS. 29-30, another embodiment of a container assembly 10 including vents that allow for fluid communication between the external environment and cavities (such as, e.g. spaces 190) formed between the inner surfaces of the sidewalls of pouch 16 and the external surfaces of mounting portion 140 when the mounting portion 140 and pouch are attached, is shown. As shown in FIGS. 29 and 30, gaps 149 are formed in the upper portion of pouch 16. Gaps 149 are formed as holes or apertures that extend from an outer surface of the sidewalls of pouch 16 to an inner surface of the sidewalls of pouch 16, creating a passageway through which fluid, such as, e.g., air, may pass. The holes or apertures in pouch 16 forming gaps 149 can be formed in pouch 16 prior to attachment of spout 14 to pouch 16. In other embodiments, gaps 149 can be formed in pouch 16 after spout 14 and pouch 16 have been attached. Although gaps 149 are illustrated as round holes, gaps 149 may include any shape or cross-section and the dimensions of gaps 149 may vary from those shown in the figures.

Figure 31:
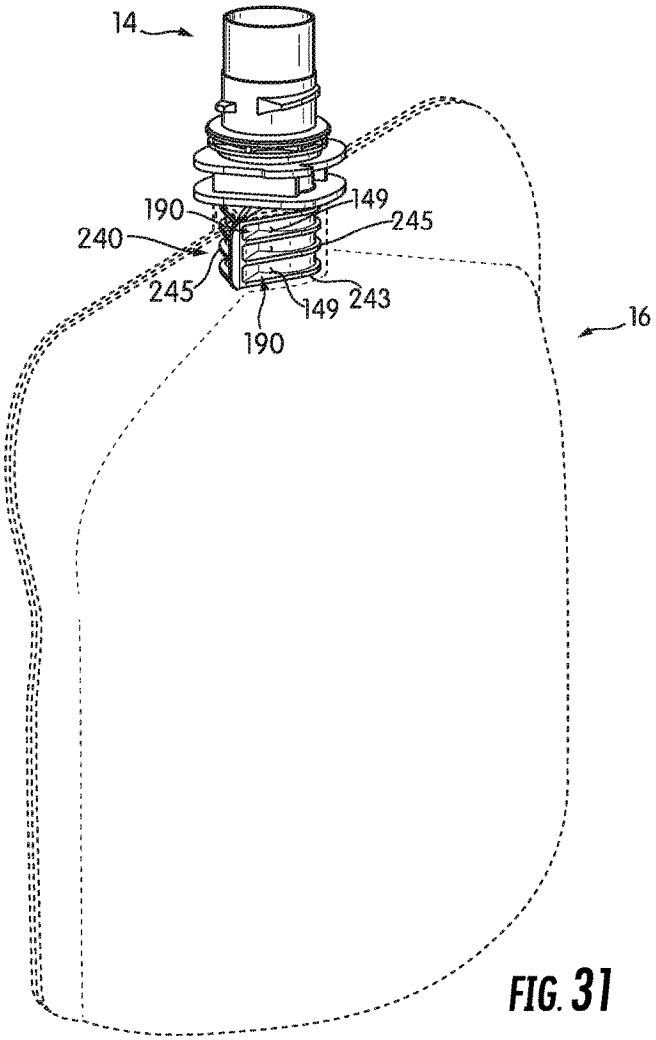
FIG. 31 is a perspective view of the container assembly of FIG. 29 according to an exemplary embodiment.
Figure 32:
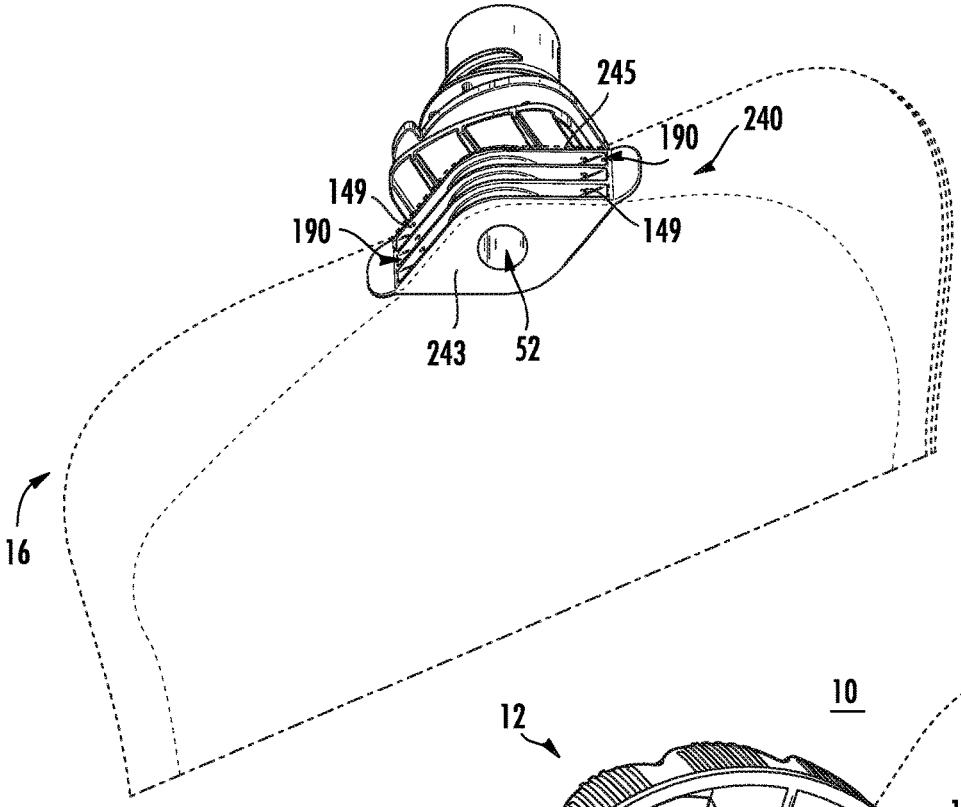
FIG. 32 is a bottom perspective view of the container assembly of FIG. 31.

As shown in FIGS. 31 and 32, in one embodiment a pouch including gaps 149 is configured to be attached to a mounting portion 240 which does not include any vent structures, similar to the conventional mounting structure 140' shown in FIGS. 2 and 3. As shown in FIGS. 31 and 32, the mounting portion 240 may include a bottom sealing wall 243 and ribs 245 whose outer perimeters are configured to form an uninterrupted, fluid-tight interface with the inner surfaces of the sidewalls of pouch 16 when the pouch 16 and spout 14 are attached. Additionally, the bottom sealing wall 243 and ribs 245 each include a solid structure that, with the exception of an opening through which tube 20 passes, includes no apertures or holes that pass from a bottom surface to a top surface. The openings in the bottom sealing wall 243 and ribs 245 through which tube 20 passes are attached to the exterior surface of tube 20 via a fluid-tight attachment.

Referring to FIGS. 31 and 32, gaps 149 are arranged on the pouch 16 such that when pouch 16 and spout 14 are attached, the gaps 149 are aligned in between adjacent ribs 245 such that gaps 149 provide a vent that allows for fluid communication between spaces 190 formed between adjacent ribs 245 and between bottommost rib 245 and bottom sealing wall 243 and the outside of the pouch 16.

Although in the embodiment of FIGS. 31 and 32 a pouch 16 including gaps 149 is shown attached to a mounting portion 240 that does not include vent structures, the pouch 16 shown in the embodiment of FIGS. 29 and 30 may be used with and attached to a mounting portion 140 including vents according to any of the embodiments disclosed herein. Similar to the embodiment shown in FIGS. 31 and 32, in such embodiments in which a mounting portion 140 including vents is attached to a pouch 16 also having vents, pouch 16 is attached to spout 14 such that the gaps 149 of pouch 16 are aligned and positioned in between ribs 145 of the mounting portion 140, such as illustratively shown in FIGS. 31 and 32.

Figure 33:
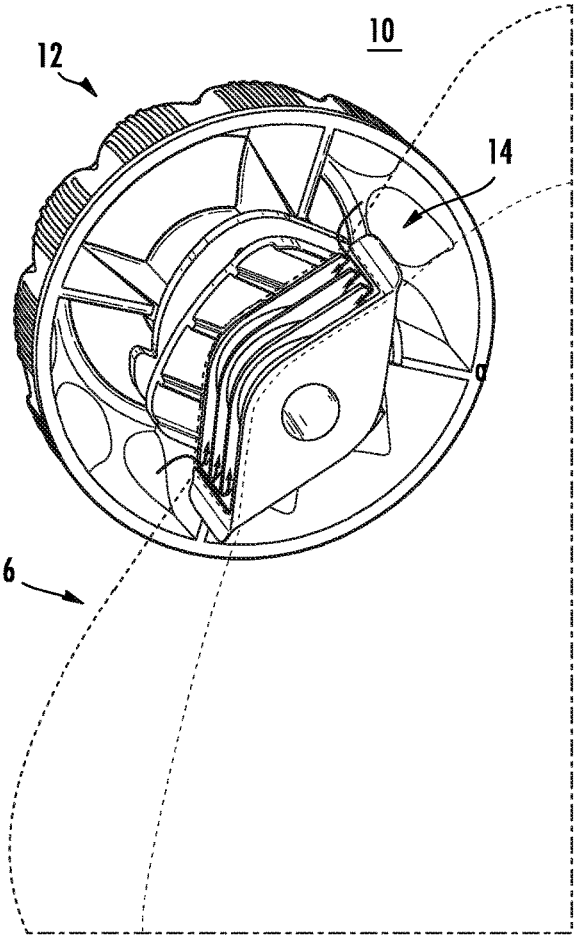
FIG. 33 illustrates a container assembly including a vent structure undergoing high pressure processing; according to an exemplary embodiment.

Referring to FIG. 33, a container assembly 10 including vent features as discussed in detail above with reference to FIGS. 13-32 is shown as the container assembly 10 undergoes HPP. As shown by the arrows in FIG. 33, as the ambient pressure surrounding the container assembly 10 increases, gaps 149 in the container assembly 10 allow for fluid communication between the outside of the container assembly 10 and spaces 190. By providing for fluid communication between the spaces 190 and the environment surrounding the outside of the container assembly 10, the pressure inside spaces 190 is able to equalize relative to the ambient pressure. Therefore, as the ambient pressure increases during HPP, the pressure inside spaces 190 is also able to correspondingly increase. As a result, the increasing forces acting on the external surface of the sidewalls of the pouch 16 resulting from the increased ambient pressure are counteracted by equal but opposite forces acting on the internal surface of the sidewalls of the pouch 16 resulting from the correspondingly increased pressure inside spaces 190. Because the forces acting on the external surface of the sidewalls of the pouch 16 are counteracted by the forces acting on the internal surfaces of the sidewalls of the pouch 16, the changing pressure occurring during HPP does not result or cause the deterioration, deformation, or other impairment of the pouch 16 and/or the attachment between the pouch 16 and mounting portion 140, which would normally occur in a container assembly formed without vents (e.g., such as shown in FIGS. 2 and 3).

Although FIG. 33 illustrates a container assembly 10 including a vent structure similar to the vent structure disclosed with reference to the embodiment of FIG. 13 undergoing HPP, a container assembly 10 including a vent structure according to any of the embodiments discussed with reference to FIGS. 13-32 above would allow for a similar equalization of internal and ambient pressures during HPP.

Although the spout 14 and pouch 16 of the embodiments illustrated in FIGS. 4-12 are not shown as including vent structures, and the spouts 14 of the embodiments of FIGS. 13-33 are not shown as having modified mounting portion 40 features as shown in and described with reference to FIGS. 4-12, it is understood that in some embodiments the spout 14 and/or pouch 16 of the embodiments of FIGS. 4-12 may be modified to include vent structures such as those described with reference to FIGS. 13-33. Similarly, it is understood that the mounting portion 140 of the spouts 14 of the embodiments of FIGS. 13-33 may be modified to include the features of the modified mounting portion 40 described with reference to FIGS. 4-12. Such container assemblies 10, having both a modified mounting portion 40 and vent features, may provide increased resistance to deformation, damage, and/or other degradation of the pouch 16 and/or pouch 16 and spout 14 interface that may result from changes in temperature and/or pressure and/or from forces being imparted onto the container assembly 10.

Figure 35:
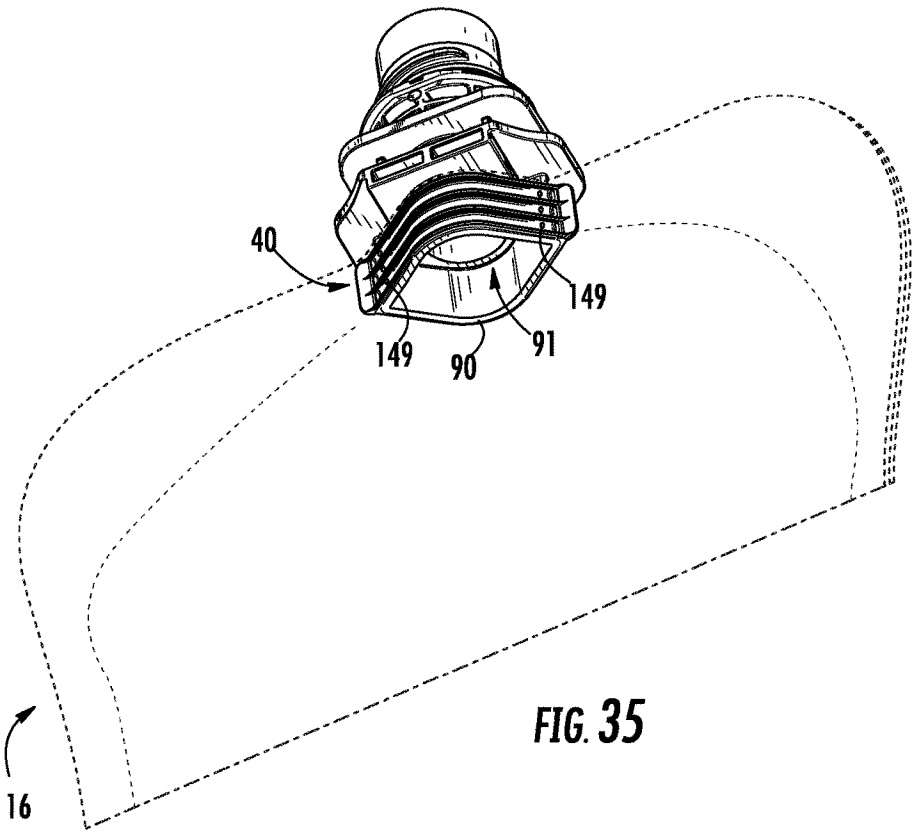
FIG. 35 is a bottom perspective view of the container assembly of FIG. 34.
Figure 34:
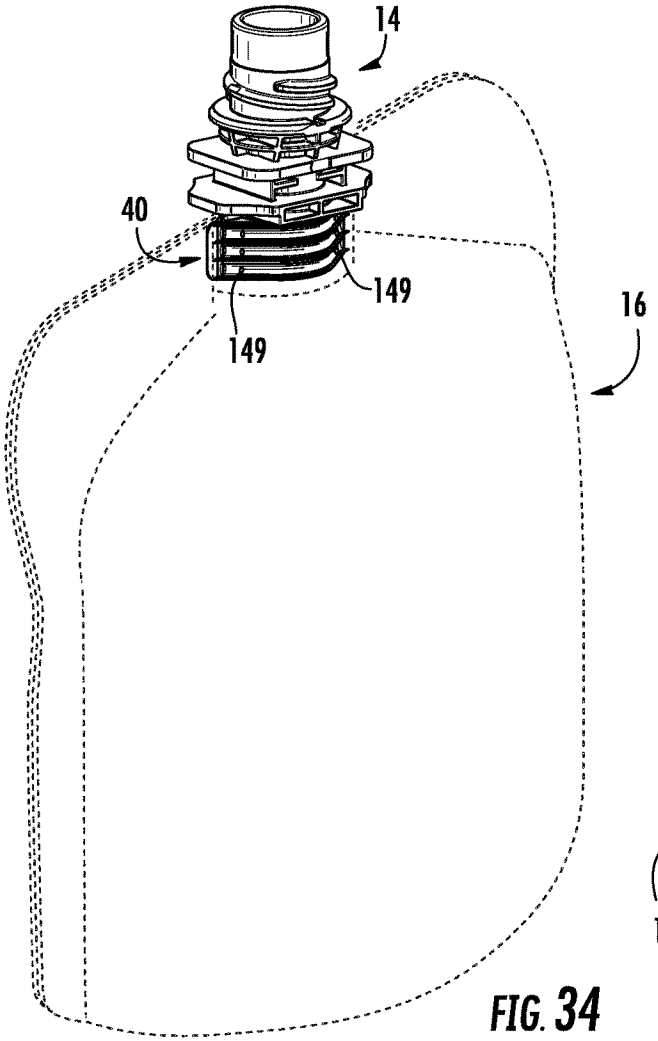
FIG. 34 is a perspective view of the container assembly of FIG. 29 having a mounting portion as shown in FIG. 4 according to an exemplary embodiment.

One example of a container assembly 10 incorporating both a modified mounting portion 40 and vent structures is illustrated in FIGS. 34 and 35. As shown in FIGS. 34 and 35, in one embodiment, the container assembly 10 may include a spout 14 with a modified mounting portion 40 such as shown and described in FIG. 4 attached to a pouch 16 having vents such as shown in and described with reference to FIGS. 29 and 30.

Referring to FIGS. 36-47B, various embodiments of a closure 12 that may be coupled to the upper end of a spout 14 to form container assembly 10 are described. It is to be understood that the various embodiments of closure 12 described below may be incorporated into a spout 14 and pouch 16 assembly according to any of, or any combination of, the embodiments discussed above and illustrated in FIGS. 4-35.

Figure 36:
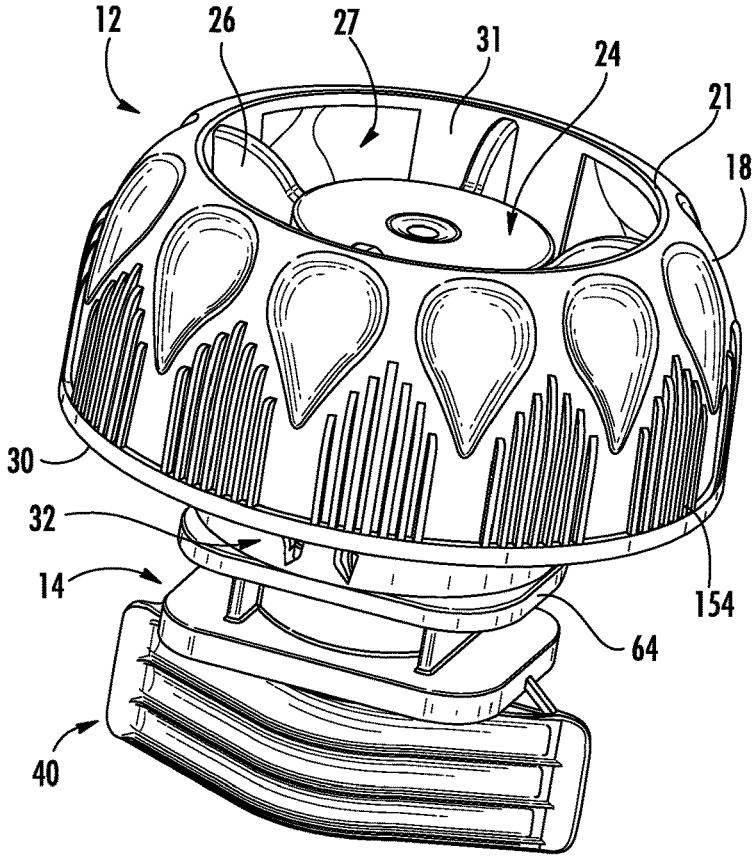
FIG. 36 is a perspective view of a closure assembly including a closure and a spout according to an exemplary embodiment.

FIG. 36 shows closure 12 coupled to an upper spout portion of spout 14 having a mounting portion 40 such as illustrated in the embodiment of spout 14 of FIG. 4. In various embodiments, closure 12 includes threads 59 that engage cooperating threads 58 on spout 14. Closure 12 includes an outer wall 18, with an interior upper edge 21 that defines a top opening. As shown in FIG. 36, outer wall 18 may include a textured design 154 molded into the exterior surface of the outer wall 18 that facilitates gripping by a user. In other embodiments, the textured design 154 may be etched, printed, or adhered to the outer wall 18. The pattern of the textured design 154 may vary in size, complexity, symmetry, or distribution. Alternatively, the outer wall 18 may be formed without a textured design 154.

Closure 12 includes a central wall portion, shown as central cylinder 24, that is coupled to an inner surface of outer wall 18 by radial walls 26 such that open spaces or channels 27 are defined within closure 12. Channels 27 extend vertically through closure 12 from interior upper edge 21 to lower edge 30 such that airflow is permitted through closure 12. As such, if the closure 12 is accidently swallowed by a user, air may flow through channels 27, allowing the user to breathe.

In one embodiment, radial walls 26 are monolithically and integrally formed with the inner surface of outer wall 18. In alternate embodiments, the radial walls 26 are formed independently and subsequently attached to the inner surface of outer wall 18. Although the embodiment shown includes four radial walls 26, closure 12 may include any number of radial walls 26 as may be appropriate based on the material of the closure 12, the dimensions of the closure 12, and the intended use of the container assembly 10.

Figure 37A:
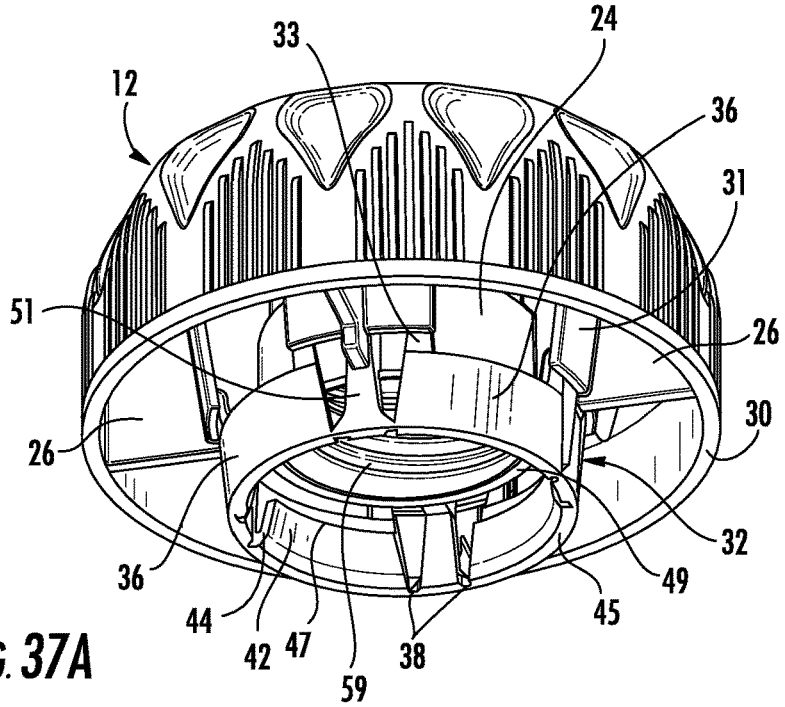
FIG. 37A is a perspective view of the closure of FIG. 36 according to an exemplary embodiment.
Figure 37B:
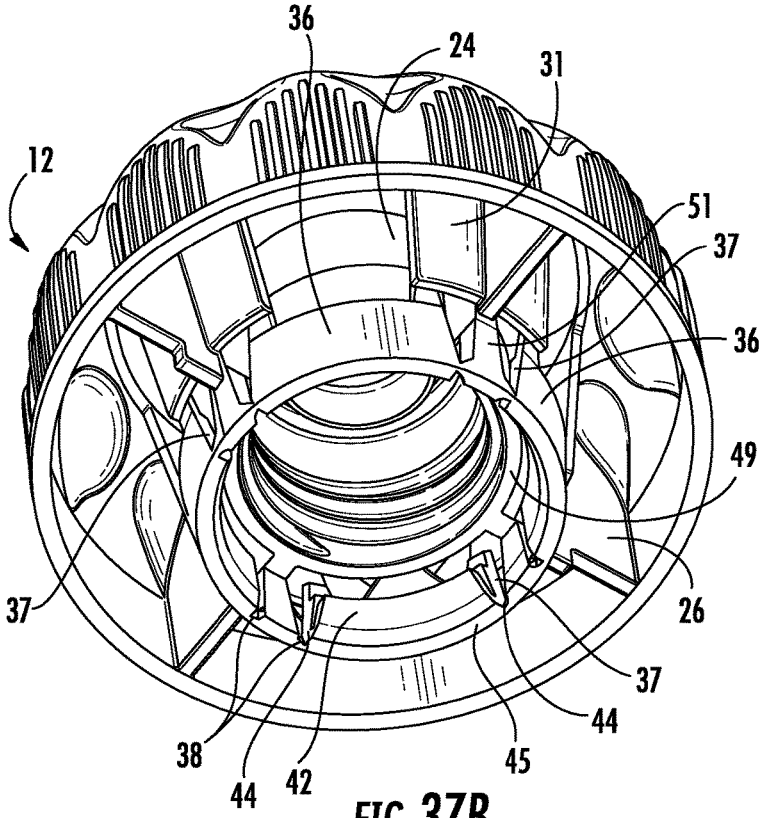
FIG. 37B is a bottom perspective view of the closure of FIG. 37A.
Figure 37C:
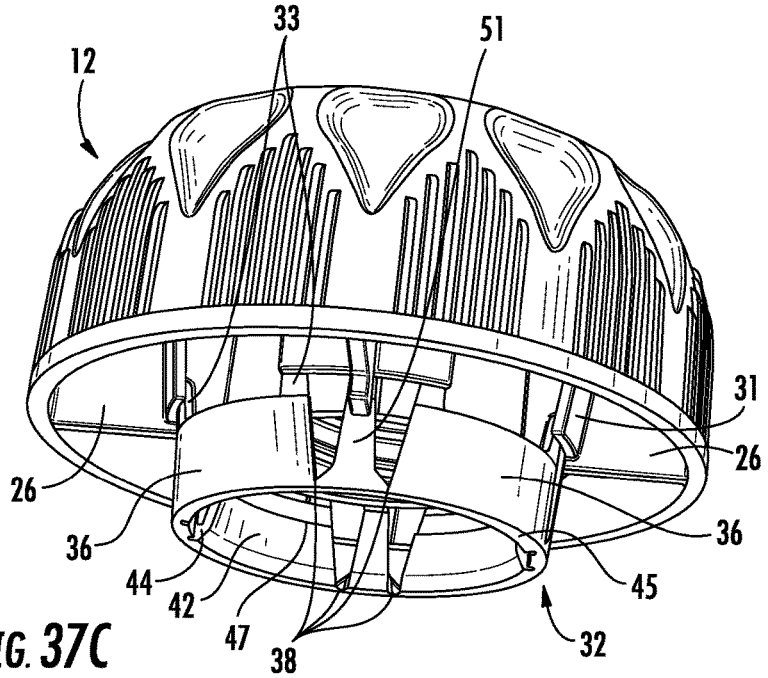
FIG. 37C is another perspective view of the closure of FIG. 37A.

Referring to FIGS. 37A-37C, a closure 12 according to one embodiment includes a tamper band 32 including wall sections 36 extending from the lower end of central cylinder 24. A pair of frangible bridge sections 38 is located between ends 37 of adjacent tamper band wall sections 36. Located on the inner surface of wall sections 36 is an engagement structure or wall, shown as J-band sections 42, that extends radially inward away from inner surfaces of wall sections 36 and upward toward the upper end of closure 12.

In the embodiment shown, J-band sections 42 are sections that are integrally molded with the rest of tamper band 32 and are connected to the lower end 45 of tamper band 32. In one embodiment, J-band sections 42 are molded in the positioning shown in FIGS. 37A-37C with a connector, shown as u-shaped curved connector section 44, molded in the u-shape shown in FIGS. 37A-37C. In another embodiment, J-band sections 42 are molded extending downward from lower end 45, and following molding, J-band sections 42 are folded upward and inward relative to tamper band 32 forming u-shaped connector section 44. In either molding arrangement, connector section 44 provides the transition from the generally downwardly extending wall section 36 to the generally upwardly extending J-band sections 42.

J-band sections 42 are angled radially inwards relative to wall sections 36. Further, J-band sections 42 each have an upper edge or surface 47 that defines the uppermost surface of each J-band section 42. J-band sections 42 have a height (e.g., the dimension in the direction of the longitudinal axis of the closure) that is less than the heights of wall sections 36. In this arrangement, the upper surface 47 of each J-band section 42 is below both the upper portion 35 of wall section 36, and below the lower most edge 49 of central cylinder 24. Further, as shown in FIG. 37A-37C, wall sections 36 have a length in the circumferential direction that is equal to or greater than the length of J-band sections 42 in the circumferential direction. In various embodiments, the angular length of wall sections 36 in the circumferential direction is greater than the angular length of J-band sections 42 in the circumferential direction.

As shown in FIGS. 37A-37C, tamper band 32 includes tamper band posts, shown as post sections 51. Post sections 51 are located in the circumferential direction between ends 37 of tamper band wall sections 36. Post sections 51 provide a structure that bridge sections 38 are coupled to. In this arrangement, the clockwise and counterclockwise facing surfaces of post sections 51 and the opposing, clockwise and counterclockwise facing ends 37 of the adjacent wall sections 36 define spaces or gaps as shown in FIGS. 37A-37C. To further provide structure to tamper band 32, post sections 51 are located below one of the radial walls 26. By providing a relatively robust, rigid and supported anchor point, this positioning of post sections 51 may facilitate consistent breakage of tamper band 32 at bridges 38 upon removal of closure 12 from spout 14 because of the relative low level of bend or distortion experienced by post sections 51 at twist off. In this arrangement, bridge sections 38 are coupled between opposing clockwise and counterclockwise surfaces of post sections 51 and of wall sections 36.

In addition to post sections 51, which initially couple the tamper band 32 to the upper portion of closure 12, tamper band 32 is also connected to the upper portion of closure 12 by hinges 33. As shown in FIGS. 37A-37C, closure 12 includes hinge support walls 31 that extend radially inwardly from the interior upper edge 21 of the closure 12 to a location proximate the upper end 43 of the tamper band 32. As shown in FIG. 37B, in one embodiment, the hinge support walls 31 are circumferentially spaced about the closure 12 such that hinge support walls 31 are bisected by, or bisect, the radial walls 26 which also extend radially inwardly from the interior upper edge 21 of the closure. In some embodiments hinge support walls 31 do not extend from and are not directly attached to upper edge 21. Instead, the support walls 31 may be supported entirely by and extending generally perpendicularly from radial walls 26.

Located at the lower edge of each hinge support wall 31 is a pair of hinges 33 that extend from the lower edge of hinge support wall 31 to the upper portion 35 of wall sections 36. As shown in FIGS. 37A-37C, hinges 33 are spaced at opposite sides of the lower edge of hinge support walls 31 and hinges 33 extend downwardly to tamper band 32 such that a first hinge 33*a* of a pair of hinges located on a hinge support wall 31 is positioned above end 37 of a first wall section 36, and the second hinge 33*b* of the pair of hinges is positioned above end 37 of an opposing adjacent wall section 36.

Along with post sections 51, the attachment of hinges 33 at opposing ends 37 of adjacent wall sections 36 along the tamper band 32 is configured to provide an additional structured and supported attachment of tamper band 32 to the upper portion closure 12. Specifically, this attachment of hinges 33 to tamper band 32 at locations generally situated above bridge pairs 38 and the positioning of each hinge 33*a*, 33*b* of a pair of hinges 33 on opposing sides of a post sections 51 is configured to increase the resistance required to break or otherwise distort the bridges 38, and thereby prevent inadvertent or accidental breakage of the tamper band 32. Additionally, by increasing this resistance, molding of the closure 12 is facilitated.

Figure 38:
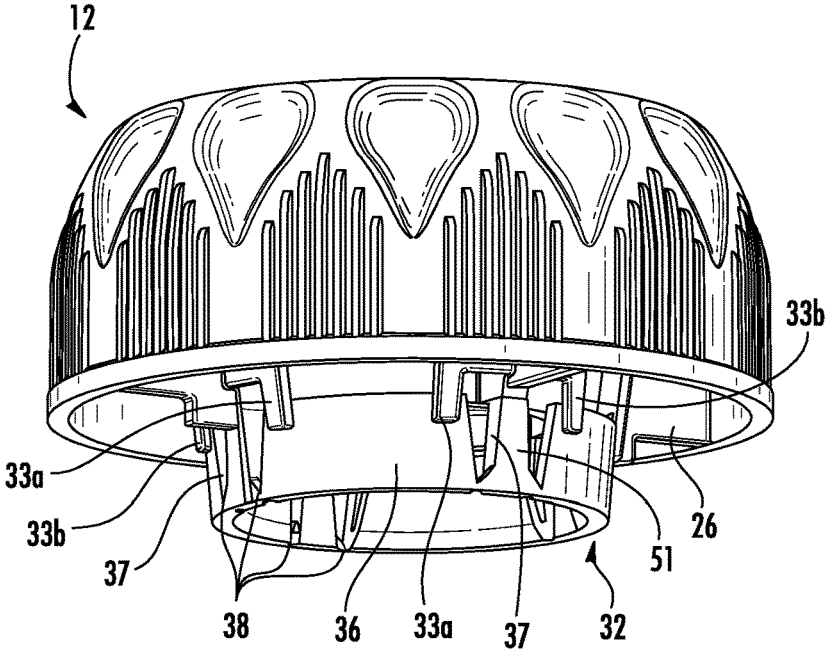
FIG. 38 is a perspective view of a closure according to an exemplary embodiment.
Figure 39:
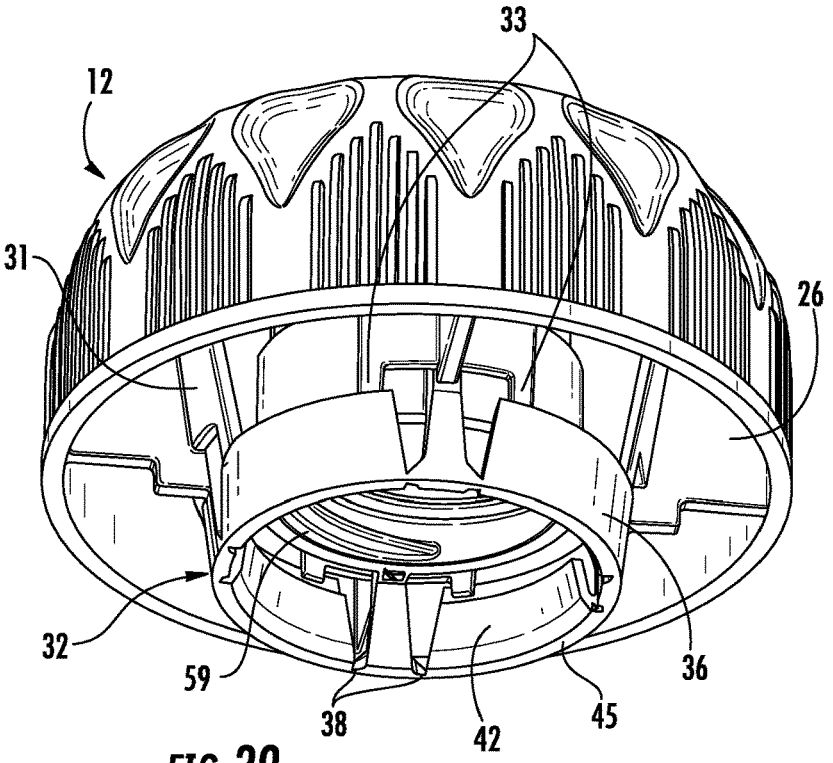
FIG. 39 is a bottom perspective view of a closure according to an exemplary embodiment.

As shown in FIGS. 37A-37C, hinges 33 may be attached to tamper band 32 along the upper edge of the upper portion 35 of wall sections 36. In other embodiments, such as shown in FIG. 38, hinges 33 may be joined to tamper band 32 at the outer surfaces of wall sections 36. In other embodiments, such as seen in FIG. 39, hinges may be connected to the tamper band 32 at the inner surfaces of wall sections 36. Hinges 33 may be attached at their upper ends to hinge support walls 31 by extending directly from the lower edge of hinge support walls 31. Alternatively, in some embodiments the upper ends of hinges 33 may be attached to either the inner or outer surfaces of the hinge support walls 31.

In some embodiments, the entire closure 12 may be monolithically formed, (e.g. by injection molding) as a single, unitary structure. In other embodiments, various components of closure 12 may initially be formed separately and may be subsequently connected together. In one embodiment, hinges 33 may be monolithically formed with hinge support walls 31 and subsequently attached to tamper band 32. In one embodiment, hinges 33 may be monolithically formed with tamper band 32 and subsequently be attached to hinge support walls 31.

In various embodiments, wall sections 36 each extend at least 120 degrees around the perimeter of central cylinder 24, specifically at least 150 degrees around the perimeter of central cylinder 24, and more specifically at least 160 degrees around the perimeter of central cylinder 24.

Figure 40:
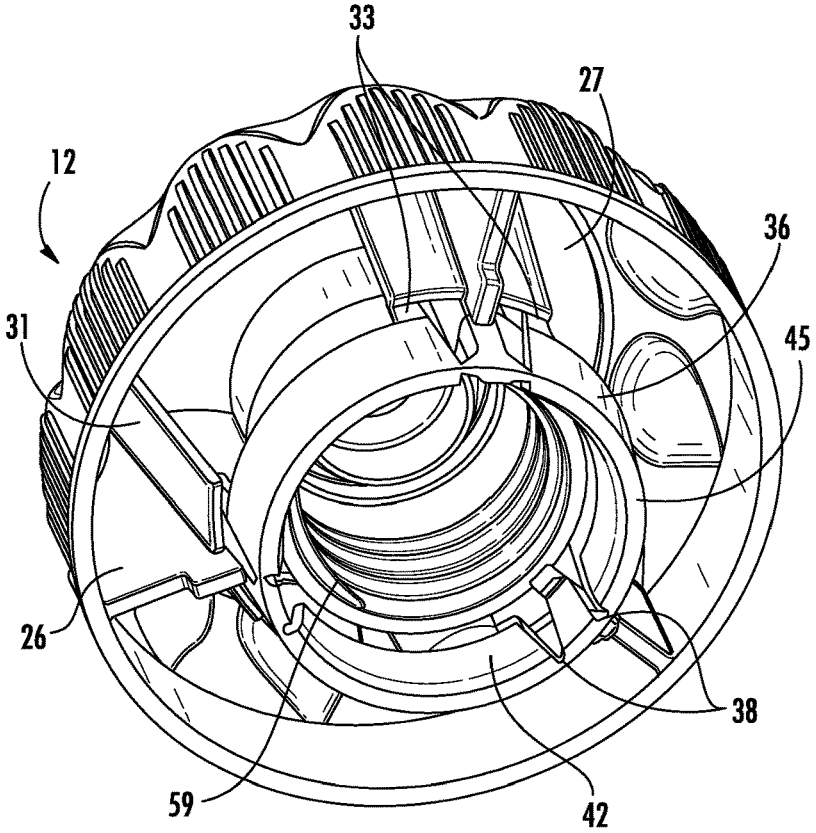
FIG. 40 is a bottom perspective view of a closure according to an exemplary embodiment.

In various embodiments, wall sections 36 are configured to provide a relatively compete band surrounding the base of central cylinder 24. In the embodiment shown in FIGS. 37A-37C, tamper band 32 includes four wall sections 36. However, tamper band 32 may include any number of wall sections 36 that are connected to adjacent wall sections 36 by a pair of bridge sections 38. As shown in FIG. 40, in one embodiment tamper band 32 includes three wall sections 36. In another embodiment, illustrated in FIGS. 41A and 41B, tamper band 32 may include two wall sections 36.

In some embodiments, as illustrated for example in FIGS. 37A-37C, the number of hinge support walls 31 and the number of pairs of hinges 33 equals the number of pairs of bridge sections 38. In other embodiments, the number of hinge support walls 31 and the number of pairs of hinges 33 may be more or may be less than the number of pairs of bridge sections 38.

Figure 41A:
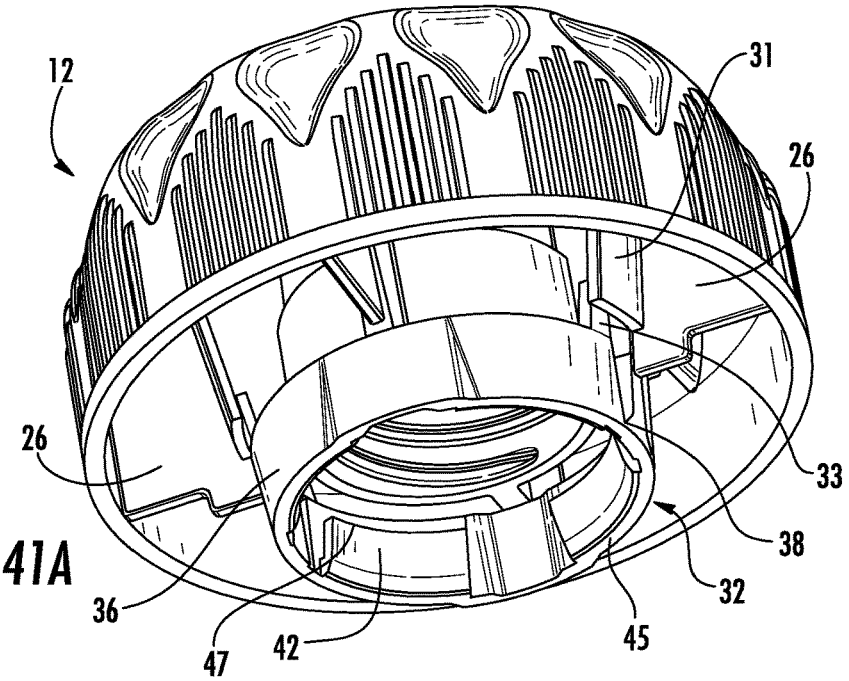
FIG. 41A is a bottom perspective view of a closure according to an exemplary embodiment.
Figure 41B:
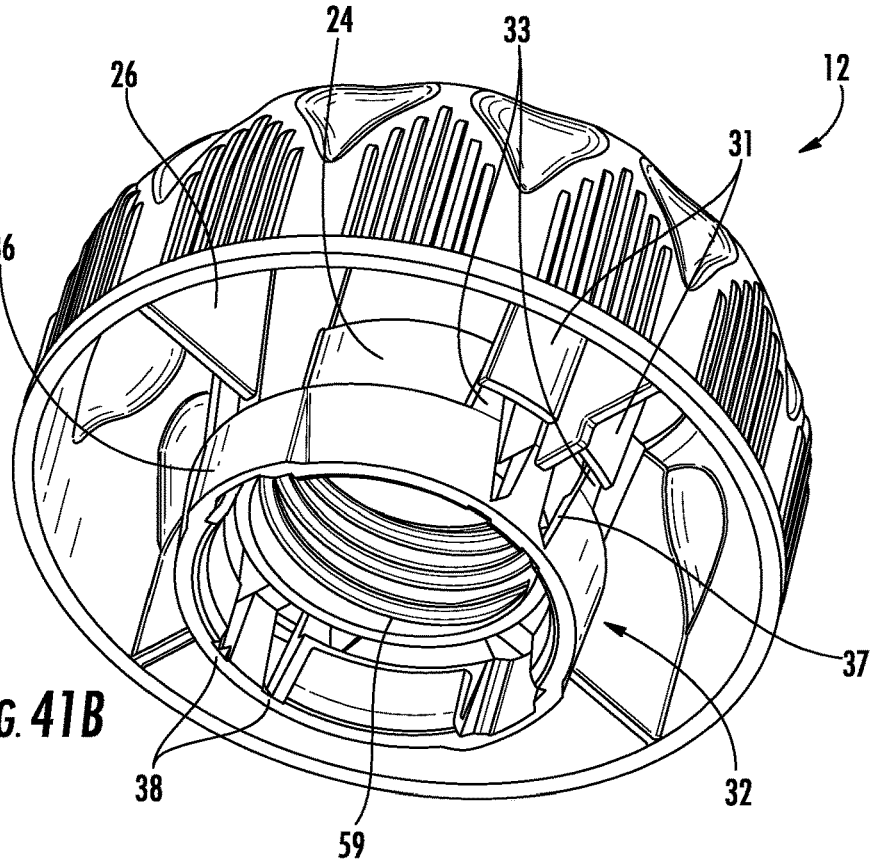
FIG. 41B is a bottom perspective view of the closure of FIG. 41A.
Figure 42:
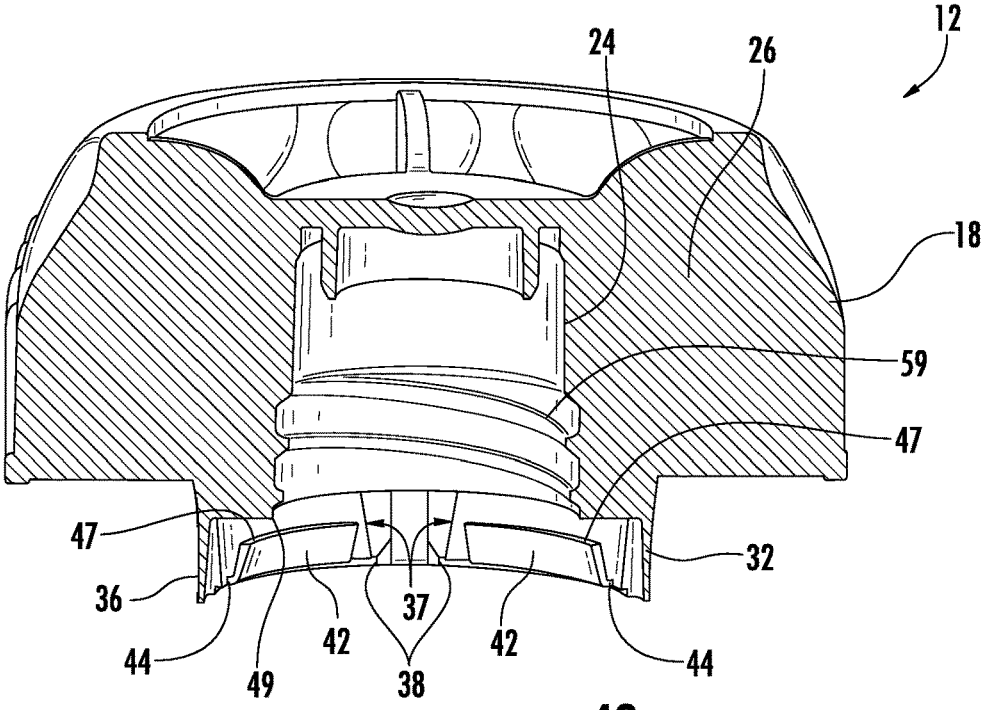
FIG. 42 is a cross-sectional view of a section of the closure of FIG. 37A.

FIG. 42 shows approximately one half of closure 12 of the embodiment illustrated in FIGS. 37A-37C in cross-section. As shown in FIG. 42, each section of each of the tamper band wall sections 36 includes one J-band section 42. Thus, in the embodiment of closure 12 shown in FIGS. 37A-37C, tamper band 32 includes a total of four J-band sections 42 and a total of four wall sections 36. However, in other embodiments, wall sections 36 may include more than one J-band section 42 (for example as shown in the embodiment of FIGS. 41A and 42B). Alternatively, in other embodiments not every wall section 36 includes a J-band section 42. As such, the tamper band 32 may include various numbers of J-band sections 42, such as 2, 3, 5, 6, etc. J-band sections.

Figure 43:
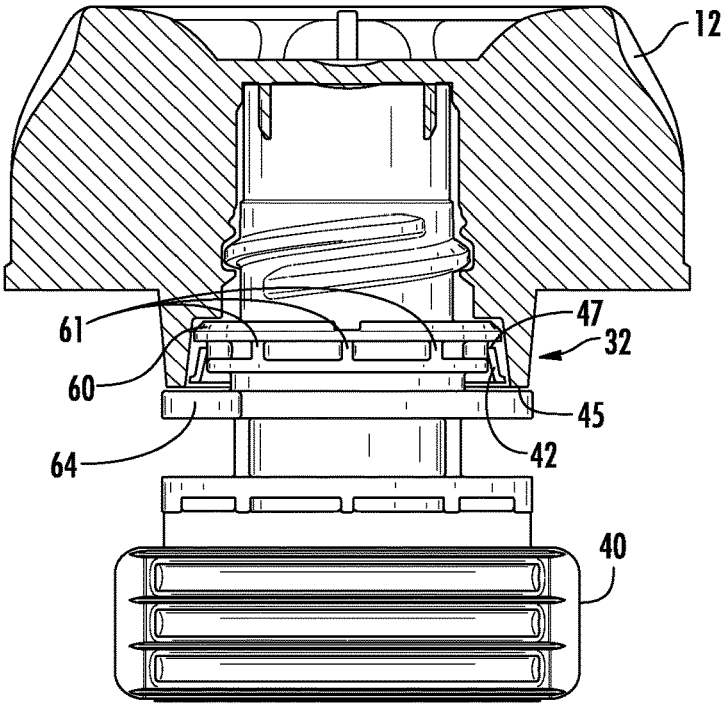
FIG. 43 is a cross-sectional view of the closure of FIG. 37A coupled to the spout of FIG. 4 according to an exemplary embodiment.

Referring to FIG. 43, a cross sectional view of closure 12 coupled to a spout 14 having a mounting portion 40 such as illustrated in the embodiment of FIG. 4 is shown. As shown in FIG. 43, when closure 12 is fully engaged on spout 14, J-band sections 42 are engaged underneath flange 60. In this arrangement, lower end 45 of tamper band 32 is facing flange 64 and there is a small amount of clearance between the lower most surface of tamper band 32 and the upper surface of flange 64. Further, J-band sections 42 are positioned such that upper surfaces 47 of each J-band are facing and located beneath flange 60.

Figure 44:
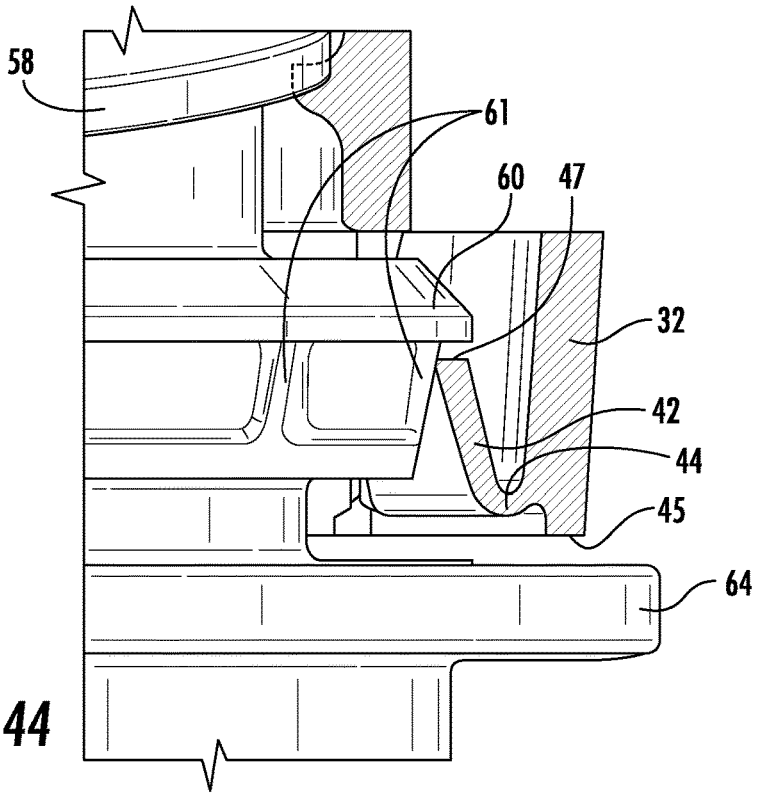
FIG. 44 is a detailed view of FIG. 43 showing the interaction between the spout and closure according to an exemplary embodiment.

Referring to FIG. 44, a detailed view of the interaction between J-bands 42 and spout 14 are shown. Spout 14 includes a plurality of generally vertically extending ribs 61 located below flange 60. Ribs 61 interact with the radially innermost section of J-band 42 during cap removal limiting the ability of J-bands 42 from tucking under flange 60. In this manner, ribs 61 provide a surface that allows J-bands 42 to transition over the outermost edge of flange 60 during cap removal.

Figure 45:
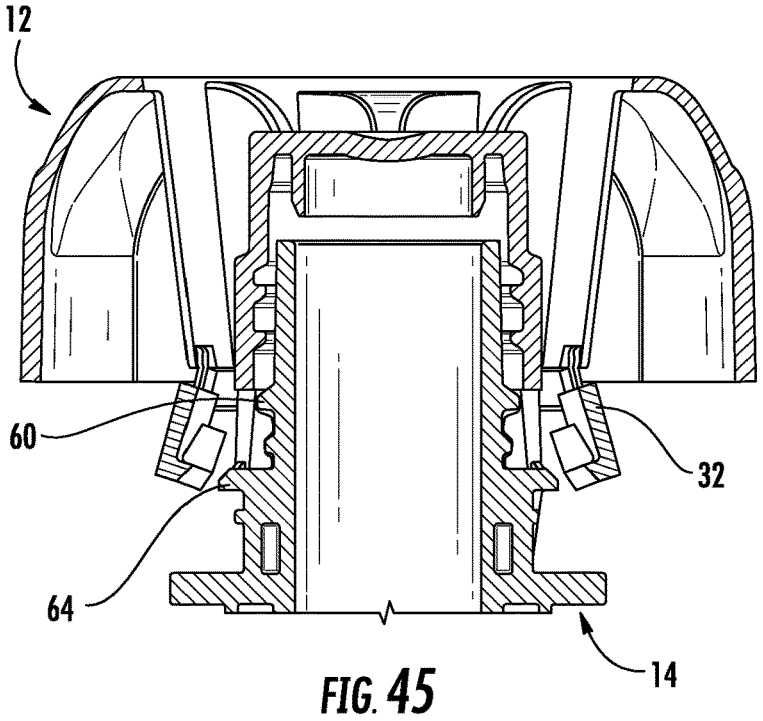
FIG. 45 is a cross-sectional view of a closure and spout assembly of FIG. 43 after the tamper band has been broken.
Figure 46:
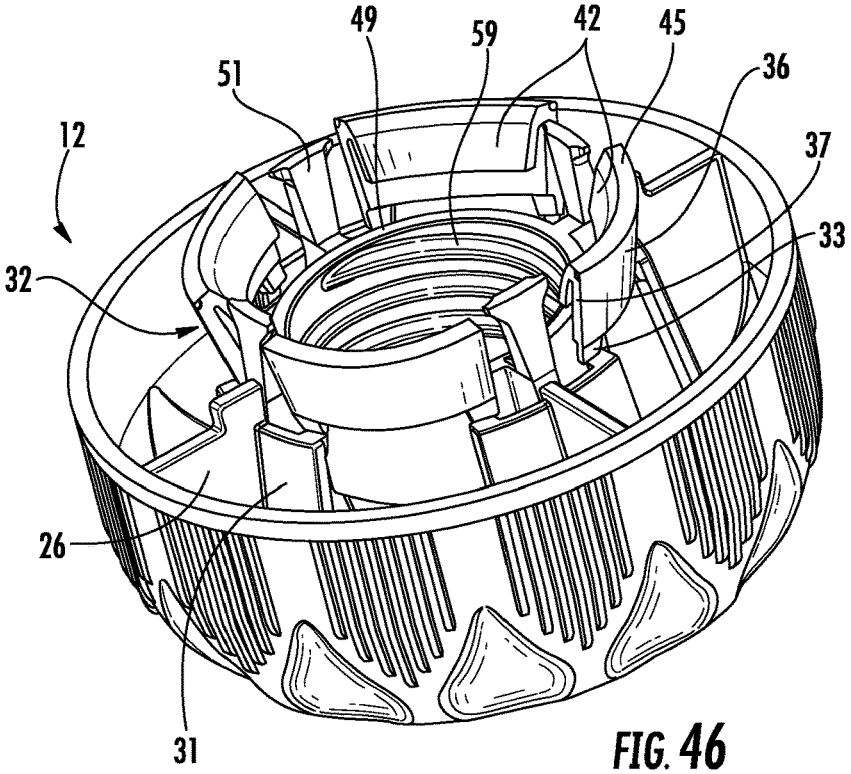
FIG. 46 is a perspective view of the bottom of the closure of FIG. 37A after the tamper band has been broken.

During removal of closure 12 from spout 14, flange 60 includes an outer surface that acts as a catch ledge. As closure 12 is twisted-off and removed, closure 12 moves upwards relative to spout 14, causing J-band sections 42 to interact with flange 60. As J-band sections 42 interact with flange 60, tamper band 32 is forced outward. As the closure 12 continues to move upwards relative to the spout 14, the interaction of J-band sections 42 with flange 60 continues to force tamper band 32 further outwards. This distortion of the tamper band 32 results in the breaking of bridge pairs 38. Specifically, as tamper band 32 passes over flange 60 upon removal of closure 12, flange 60 acts to spread broken tamper band 32 and pushes broken tamper band 32 radially outward. The broken sections of tamper band 32 pivot radially outward about hinges 33 under the interaction with flange 60, as shown in FIG. 45 and FIG. 46.

Figure 47A:
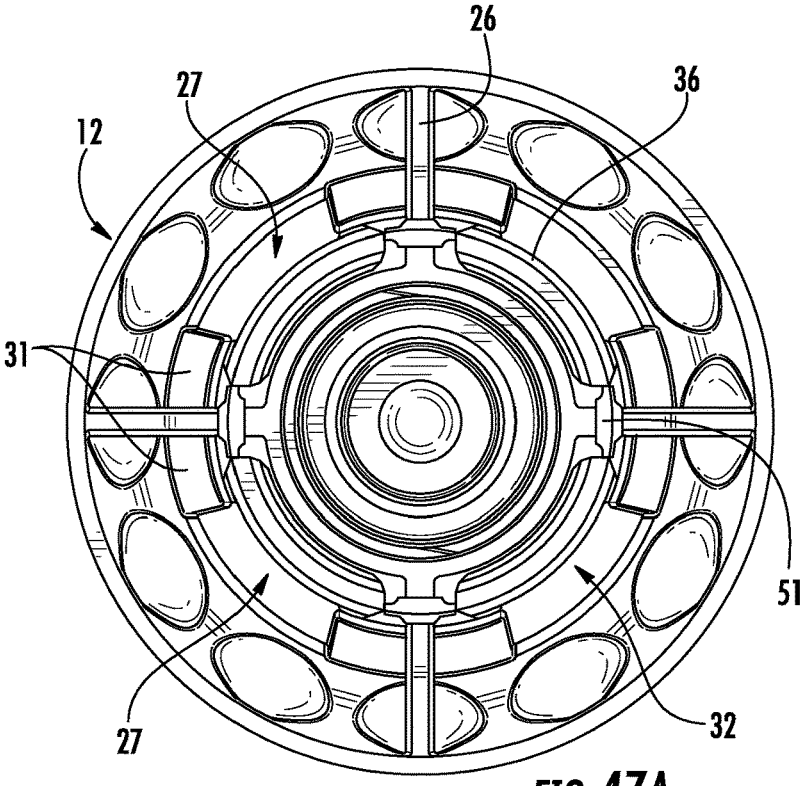
FIG. 47A is a bottom view of the closure of FIG. 37A with an intact tamper band.
Figure 47B:
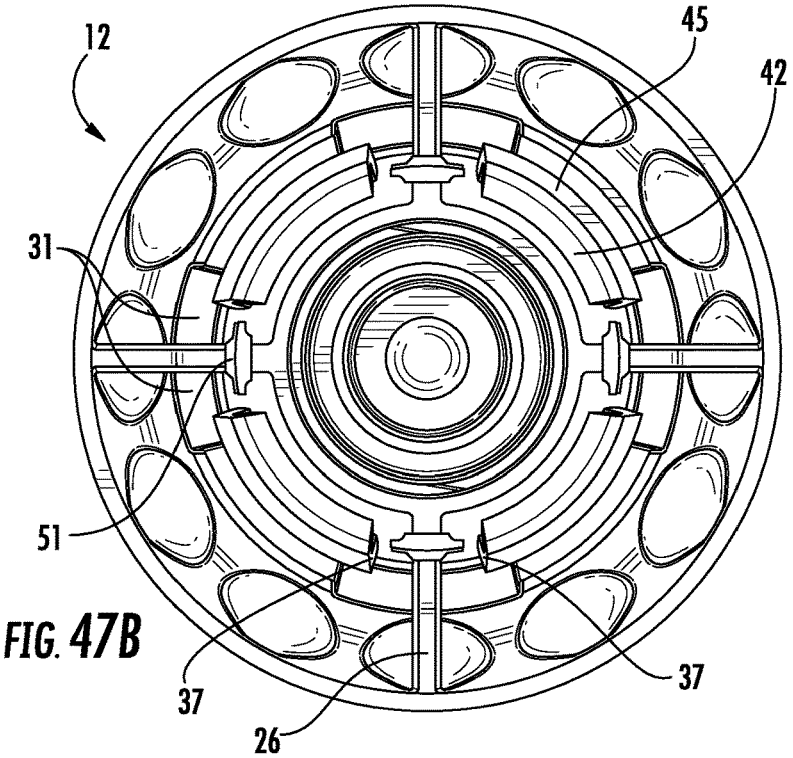
FIG. 47B is a bottom view of the closure of FIG. 37A with a broken tamper band.

A shown by the comparison of closure 12 prior to removal (as shown in FIG. 47A) to the closure 12 after the tamper band 32 has been broken (as shown in FIG. 47B), the broken bridge sections 38 and the radially outwardly displaced tamper band 32 provides visual tamper indication to a user that the closure 12 has previously been opened. As shown in FIG. 47B, because the wall sections 36 are attached to the upper portion of closure 12 at each end by hinges 33, once the tamper band 32 has been broken, the wall sections 36 are constrained in the manner in which the wall section 36 outwardly deflect. Furthermore, because the wall sections 36 are attached at each end by hinges 33, the free ends of broken bridges are relatively radially constrained by the hinged attachment of wall sections 36. Because the hinged connection of wall section 36 is configured to prevent the free ends from significantly projecting radially outwards from closure 12, in the event that the closure 12 is accidently swallowed by a user, the damage to the user's airway caused by the free ends of the wall sections 36 may be minimized.

Although the closure 12 has been described as having a tamper band 32 comprising J-band sections 42 which are configured to interact with flange 60 of spout 14 during twist-off and removal of the closure to break the tamper band 32, in other embodiments the hinged tamper band 32 may comprise structures other than J-band sections 42 that interact or engage with spout 14 to break the hinged tamper band. For example, in one embodiment, tamper band may comprise one or more radially inwardly projecting flanges that extend from the inner wall sections 36. In such an embodiment, spout 14 may include one or more structures configured to interact with the flanges of tamper band during twist-off to break tamper band. In other embodiment, the hinged tamper band may comprise wall sections 36 that include gaps that are initially positioned about outwardly extending flanges formed on spout 14. In such an embodiment, during twist-off the flanges of spout interact with the gaps of wall sections to break the hinged tamper band.

In various embodiments, the closure 12 and/or spout 14 may be formed from a molded plastic material. In various embodiments, closure 12 and/or spout 14 may be polyethylene, polypropylene, polyethylene terephthalate, or any other suitable plastic material. In various embodiments, the closure 12 and/or spout 14 may be formed through any suitable molding method including, injection molding, compression molding, etc.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

For purposes of this disclosure, the term "coupled" or "attached to" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above in the implementation of the teachings of the present disclosure.

What is claimed is:

1. A spout for attachment to a flexible pouch comprising:

a cylindrical tube surrounding a central channel, the tube having an inlet end and an outlet end;

a mounting portion located along a lower portion of the tube, the mounting portion comprising:

first and second walls, each of the first and second walls having an interior surface, an exterior surface, a first vertical edge and a second vertical edge, the first and second walls attached to one another along their first and second vertical edges; and an opening defined between the interior surfaces of the first and second walls, the opening being in fluid communication with the inlet end of the tube so that contents of a pouch may be accessed from outside of the pouch through the central channel and the opening;

wherein the exterior surfaces of each of the first and second walls define a curvilinear wave-like pattern formed of alternating peaks and troughs, the pattern of each of the first and second exterior surfaces extending along a height of the mounting portion from bottom ends of the first and second walls to top ends of the first and second walls, wherein at least one of the pouch and the mounting portion include one or more vents that allows for fluid communication between the outside environment and the interior of at least one or more cavities that are formed between adjacent peaks.

2. The spout of claim 1, wherein a length P is defined by a length of a perimeter of a portion of the exterior surface of the first wall extending from a crest of a first peak located on the first wall to a crest of an adjacent second peak located on the first wall, and a length H is defined by a height measured between the crests of the first peak and the adjacent second peak, wherein the length P is no more than 10% greater than the length H.

3. The spout of claim 2, where the length P is no more than 5% greater than the length H.

4. The spout of claim 1, wherein at least one weld rib is formed on the crest of at least one peak.

5. The spout of claim 1, further comprising a first generally planar structure extending outwards from the first vertical edges of the first and second walls and a second generally planar structure extending outwards from the second vertical edges of the first and second walls.

6. The spout of claim 1, wherein the exterior surfaces of the walls are free of any radially outwardly extending structures that are formed with edges defined by angles or small radii of curvature.

7. The spout of claim 1, further including a pouch having an interior attached to the mounting surfaces of the raised elements.

8. The spout of claim 7, wherein contents are located within the interior of the pouch.

9. A pouch and spout assembly comprising:

a pouch defining an interior in which contents may be stored;

a spout having:

a flow channel that fluidly connects the interior of the pouch with a location outside the pouch;

a mounting portion formed about the flow channel, the mounting portion comprising a generally vertically extending wall having an inner surface and an exterior surface, the inner surface of the wall defining an opening that is in fluid communication with the flow channel and the interior of the pouch;

one or more mounting structures extending radially outwards from and spaced along a height of the exterior surface of the wall, an inner surface of the pouch being sealed to the spout along the mounting structures to form a fluid-tight interface; and one or more cavities formed between adjacent mounting structures, each cavity being bounded in its entirety by the inner surface of the portion of the pouch extending between the adjacent mounting structures and the portion of the exterior surface of the wall extending between the adjacent mounting structures;

wherein the arrangement of the mounting structures along the exterior surface of the wall prevents the portion of the pouch extending between adjacent mounting structures to stretch any more than 10% relative to the original length of the portion of the pouch when the pouch is forced radially inwards from an initial location towards the exterior surface of the wall; and wherein at least one of the pouch and the mounting portion include one or more vents that allows for fluid communication between the outside environment and the interior of at least one of the one or more cavities.

10. The assembly of claim 9, further comprising contents stored within the pouch interior.

11. The assembly of claim 9, wherein the exterior surface of the wall defines a curvilinear wave-like pattern formed of alternating peaks and troughs, the pattern extending along a height of the mounting portion from a bottom end to a top end of the mounting portion.

12. The assembly of claim 9, wherein the pouch and spout are welded together along at least one weld rib located on at least one of the one or more mounting structures.

* * * * *